US011661253B2

(12) United States Patent
Park

(10) Patent No.: US 11,661,253 B2
(45) Date of Patent: May 30, 2023

(54) PACKING STRUCTURE

(71) Applicant: PUZZLELOCK INC., Ansan-si (KR)

(72) Inventor: Hyun-Jin Park, Seoul (KR)

(73) Assignee: PUZZLELOCK INC.

( * ) Notice: Subject to any disclaimer, the term of this patent is extended or adjusted under 35 U.S.C. 154(b) by 0 days.

(21) Appl. No.: 17/268,477

(22) PCT Filed: Aug. 7, 2019

(86) PCT No.: PCT/KR2019/009878
§ 371 (c)(1),
(2) Date: Feb. 14, 2021

(87) PCT Pub. No.: WO2020/040456
PCT Pub. Date: Feb. 27, 2020

(65) Prior Publication Data

US 2021/0179328 A1 Jun. 17, 2021

(30) Foreign Application Priority Data

Aug. 20, 2018 (KR) ..... 10-2018-0096991
Jan. 14, 2019 (KR) ..... 10-2019-0004695

(51) Int. Cl.
*B65D 53/02* (2006.01)
*B65D 43/02* (2006.01)

(52) U.S. Cl.
CPC ..... *B65D 53/02* (2013.01); *B65D 43/022* (2013.01)

(58) Field of Classification Search
CPC ..... B65D 53/02; B65D 43/022; F16L 17/025
USPC ..... 220/378; 277/615; 285/110
See application file for complete search history.

(56) References Cited

U.S. PATENT DOCUMENTS 2,980,449 A * 4/1961 Dunton ..... F16L 17/025 277/615
3,173,694 A * 3/1965 Nathan ..... F16L 17/035 277/314
3,498,623 A * 3/1970 Rowe ..... F16L 17/025 277/605
4,298,206 A * 11/1981 Kojima ..... F16L 21/04 277/626
5,868,273 A * 2/1999 Daenen ..... B65D 43/0212 220/795
5,967,363 A 10/1999 Allen
7,665,624 B2 * 2/2010 Enomoto ..... F16J 15/062 220/304
8,042,816 B2 * 10/2011 Krausz ..... F16L 17/04 277/607
2010/0270304 A1 * 10/2010 Chen ..... B65D 43/022 220/231

FOREIGN PATENT DOCUMENTS

GB 1466208 A * 3/1977 ..... E03F 3/04
JP 2004-197882 A 7/2004
KR 10-0973159 B1 8/2010
KR 10-1133979 B1 4/2012
KR 10-1272819 B1 6/2013

* cited by examiner

*Primary Examiner* — James N Smalley

(57) ABSTRACT

The present invention relates to a packing structure for packing a gap between two bodies, and more particularly, to a packing structure which tightly seals a gap between two bodies and maintains the tight contact therebetween for a long time.

2 Claims, 31 Drawing Sheets

$t1 > t2$

PACKING STRUCTURE

CROSS-REFERENCE TO PRIOR APPLICATIONS

This application is a national Stage Patent Application of PCT International Patent Application No. PCT/KR2019/009878, filed on Aug. 7, 2019 under 35 U.S.C. § 371, which claims priority of Korean Patent Application Nos. 10-2018-0096991, filed on Aug. 20, 2018 and 10-2019-0004695, filed on Jan. 14, 2019, which are all hereby incorporated by reference in their entirety.

TECHNICAL FIELD

The present invention relates to a packing structure, and more particularly, to a packing structure that is capable of tightly sealing a gap between two bodies and capable of maintaining the tight contact therebetween.

BACKGROUND ART

Generally, various kinds of food or food materials are put and stored in airtight containers with different sizes and shapes. If the airtight containers with various sizes are prepared according to an amount of food or material to be stored therein, the number of airtight containers increases to require a large space for arrangements of the containers. Further, if the amount of food or food material stored in one airtight container decreases, the food or food material has to move to another airtight container smaller than the airtight container so as to enhance degrees of space utilization of the containers. So as to solve such problem, a container adjustable in height is disclosed in Korean Patent No. 10-1493878, and the conventional container is capable of being adjustable in height to increase and decrease an amount of content accommodated therein, thereby being advantageous in utilizing space, keeping the freshness of the content, and washing.

FIG. 1 shows the conventional container adjustable in height. Referring to FIG. 1, the conventional container 1 adjustable in height includes a first body 10 having a plurality of height adjusting parts 12 located on the outer periphery thereof in upward and downward directions, each height adjusting part 12 having a plurality of guide grooves arranged thereon in such a manner as to be inclined symmetrically to each other and a plurality of fixing grooves connected horizontally with the guide grooves in such a manner as to be alternately arranged up and down, a second body 20 fitted to the first body 10 and having guide protrusions 22 guided along the height adjusting parts 12, and a cap 30 for opening and closing top of the second body 20, so that as the guide protrusions 22 of the second body 20 move upward and downward along the height adjusting parts 12, the entire height of the container 1 can be adjusted. Further, a ring-shaped rubber packing member 18 is provided along an installation groove 19 formed on a top outer periphery of the first body 10 so as to allow the first body 10 to come into tight contact with the inner periphery of the second body 20. The packing member 18 is configured to seal a gap between the first body 10 and the second body 20.

FIG. 2 is a sectional view showing a specific structure of the packing member applied to the conventional container adjustable in height.

Referring to FIGS. 1 and 2, the conventional packing member 18 includes a ring-shaped support portion 18*a* inserted into the installation groove 19 of the first body 10 and one or more protrusion portions 18*b* protruding from the support portion 18*a* toward the inner periphery of the second body 20. Also, the end peripheries of the protrusion portions 18*b* come into close contact with the inner periphery of the second body 20. As a pushing force applied from the end peripheries of the protrusion portions 18*b* to the inner periphery of the second body 20 is relatively weak, however, the end peripheries of the protrusion portions 18*b* are momentarily separated from the second body 20 in a process where the second body 20 moves upward or downward, and through the gap generated, in this case, external air may enter the first body 10 and the second body 20. Otherwise, the food accommodated in the first body 10 and the second body 20 may be discharged to the outside.

Referring to an injection molding process for making the packing member 18, on the other hand, a resin is injected into a mold (not shown) having the shape of the packing member 18, and after that, if the resin is cured, the cured resin is separated from the mold to obtain the packing member 18 finally made. When the cured resin is forcedly separated from the mold, however, the inner periphery of the packing member 18, which is inserted into the installation groove 19, is not separated from the mold well, and in some cases, accordingly, a scrab portion may protrude unnecessarily from the inner periphery of the packing member 18. Even in a process of other molding like press molding, the scrab portion may protrude unnecessarily from the inner periphery of the packing member 18. As the scrab portion inhibits the inner periphery of the packing member from coming into close contact with the installation groove 19, undesirably, a gap may be formed between the inner periphery of the packing member 18 and the installation groove 19.

DISCLOSURE

Technical Problem

Accordingly, the present invention has been made in view of the above-mentioned problems occurring in the related art, and it is an object of the present invention to provide a packing structure that is capable of tightly sealing a gap between a first body and a second body.

It is another object of the present invention to provide a packing structure that is capable of being preventing from turning over in a process where a second body moves upward and downward.

It is yet another object of the present invention to provide a packing structure that is capable of preventing a scrab portion formed in a molding process thereof from having no influence on a sealing force thereof.

Technical Solution

To accomplish the above-mentioned objects, according to one aspect of the present invention, there is provided a packing structure having a packing located between one side of a first body and one side of a second body facing each other, the packing including a tight contact portion whose inner periphery coming into close contact with one side of the first body, an extension portion extended inclinedly upward from the lower outer periphery of the tight contact portion toward one side of the second body, and a support protrusion protruding from the outer periphery of the tight contact portion facing the extension portion toward the extension portion.

Further, if the extension portion is elastically deformed toward the tight contact portion by means of the pressure applied from one side of the second body, the support protrusion supports the extension portion in an outward direction thereof and the tight contact portion is kept in a state of coming into tight contact with the first body.

Furthermore, if a downward pressure is applied to top end periphery of the extension portion coming into contact with the second body when the second body moves downward, a pressurization point located on top end periphery of the extension portion in such a manner as to come into contact with the support protrusion is supported against the support protrusion, so that the top end periphery of the extension portion is supported, without any downward deformation.

Moreover, the pressurization point coming into contact with the support protrusion enters the inner periphery of the extension portion by means of the pressurization of the support protrusion.

The packing structure according to the present invention further includes a protrusion portion protruding bendedly from the outer periphery of the extension portion toward one side of the second body.

The packing structure according to the present invention further includes an auxiliary protrusion protruding from the outer periphery of the extension portion that does not face the tight contact portion, so that if the extension portion is elastically deformed toward the tight contact portion by means of the pressure applied from one side of the second body, the auxiliary protrusion is kept in a state of coming into tight contact with one side of the second body.

Also, the tight contact portion has a connection portion protruding from the lower periphery thereof in such a manner as to be connected unitarily to the lower periphery of the extension portion.

Further, the tight contact portion has a connection portion protruding from the lower periphery thereof in such a manner as to be connected unitarily to the lower periphery of the extension portion, and the auxiliary protrusion is located lower than the support protrusion, so that if the extension portion is elastically deformed toward the tight contact portion by means of the pressure applied to the auxiliary protrusion from one side of the second body coming into contact with the auxiliary protrusion, the lower periphery of the extension portion is elastically deformed and is thus bent toward the gap between the connection portion and the support protrusion.

Moreover, the tight contact portion includes an auxiliary contact protrusion protruding from the inner periphery thereof.

To accomplish the above-mentioned objects, according to another aspect of the present invention, there is provided a packing structure having a packing located between one side of a first body and one side of a second body facing each other, the packing including a tight contact portion whose inner periphery coming into close contact with one side of the first body, an extension portion extended inclinedly upward from the lower outer periphery of the tight contact portion toward one side of the second body, a protrusion portion protruding from the outer periphery of the extension portion toward one side of the second body, and a contact portion protruding bendedly upward from the end periphery of the protrusion portion in such a manner as to move and come into contact with the tight contact portion by means of one side of the second body.

Also, the protrusion portion is elastically deformed toward the tight contact portion by means of the pressure applied to the protrusion portion from one side of the second body coming into contact with the protrusion portion, and a thickness of the protrusion portion is larger than a thickness of the extension portion.

Moreover, the contact portion protrudes bendedly upward from the end periphery of the protrusion portion in such a manner as to be inclined toward a direction distant from the protrusion portion.

Further, the extension portion includes a top extension portion, an underside extension portion located on the underside of the top extension portion, and a vertical extension portion extended from the side periphery of the top extension portion connected to the tight contact portion in such a manner as to be vertical with respect to the tight contact portion.

Further, the extension portion includes a top extension portion and an underside extension portion located on the underside of the top extension portion, and a thickness between top of the top extension portion and top of the underside extension portion is larger than a thickness between underside of the top extension portion and underside of the underside extension portion.

Also, the first body includes a concave portion formed on one side thereof in such a manner as to insert the tight contact portion thereinto, and the concave portion includes a fitting concave portion formed on one side or both sides thereof in such a manner as to fit the end periphery of the tight contact portion thereto.

Advantageous Effects

According to the present invention, the packing structure is configured to allow the support protrusion to be pressurized against the extension portion, so that the support protrusion pressurizes the tight contact portion toward the first body, thereby tightly sealing the gap between the tight contact portion and the first body.

In addition, the packing structure according to the present invention is configured to allow the support protrusion to pressurize the extension portion toward the second body, thereby tightly sealing the gap between the protrusion portion connected to the extension portion and the second body.

Also, the packing structure according to the present invention is configured to allow the extension portion to have the vertical extension portion adapted to apply a strong pressure to the first body, thereby tightly sealing the gap between the tight contact portion connected to the vertical extension portion and the first body.

Further, the packing structure according to the present invention is configured to allow the extension portion to come into contact with the support protrusion when the second body moves downward, so that the extension portion is supported against the support protrusion and is thus prevented from turning over.

Furthermore, the packing structure according to the present invention is configured to allow the auxiliary contact protrusion to protrude from the tight contact portion in such a manner as to come into close contact with the first body, irrespective of the scrab portion formed on the packing, thereby tightly sealing the gap between the tight contact portion and the first body.

Moreover, the packing structure according to the present invention is configured to allow the auxiliary protrusion protruding from the extension portion and the protrusion portion to come into tight contact with the second body, thereby doubly sealing the gap between the extension portion and the second body through the auxiliary protrusion and the protrusion portion.

Additionally, the packing structure according to the present invention is configured to allow the lower periphery of the extension portion to be elastically deformed and thus bent toward the gap between the connection portion and the support protrusion, but in this case, a force of returning to a state before bent is applied to the extension portion by means of its elastic force, so that the auxiliary protrusion connected to the extension portion can come into contact with the second body more tightly.

Furthermore, the packing structure according to the present invention is configured to allow the contact portion to be elastically deformed in such a manner as to be distant from the second protrusion portion if the second body pressurizes the second protrusion portion toward the first body, and in this case, through its own tension of the contact portion, the contact portion pressurizes the second tight contact portion more strongly, so that the gap between the contact portion and the second tight contact portion can be tightly sealed. Further, in the process where the contact portion is elastically deformed toward the second tight contact portion, additional tension occurs, and accordingly, a pressure is applied from the second protrusion portion to the second body, so that the gap between the second protrusion portion and the second body can be tightly sealed. Also, since a pressure is applied from the contact portion to the second tight contact portion, the gap between the second tight contact portion and the first body can be tightly sealed.

In addition, the packing structure according to the present invention is configured to allow the top periphery of the extension portion to be thicker than the bottom periphery thereof, and in this case, the elastic strength of the top periphery of the extension portion becomes stronger than that of the bottom periphery thereof, so that if the second body moves downward, the protrusion portion does not turn over arbitrarily in the downward direction by means of the strong elastic strength of the extension portion.

Further, the packing structure according to the present invention is configured to allow the end periphery of the tight contact portion to be fitted to the fitting concave portion, so that the tight contact portion can be firmly coupled to the concave portion, without any escape from the concave portion.

EXPLANATIONS OF REFERENCE NUMERALS IN THE DRAWINGS

Figure 1:
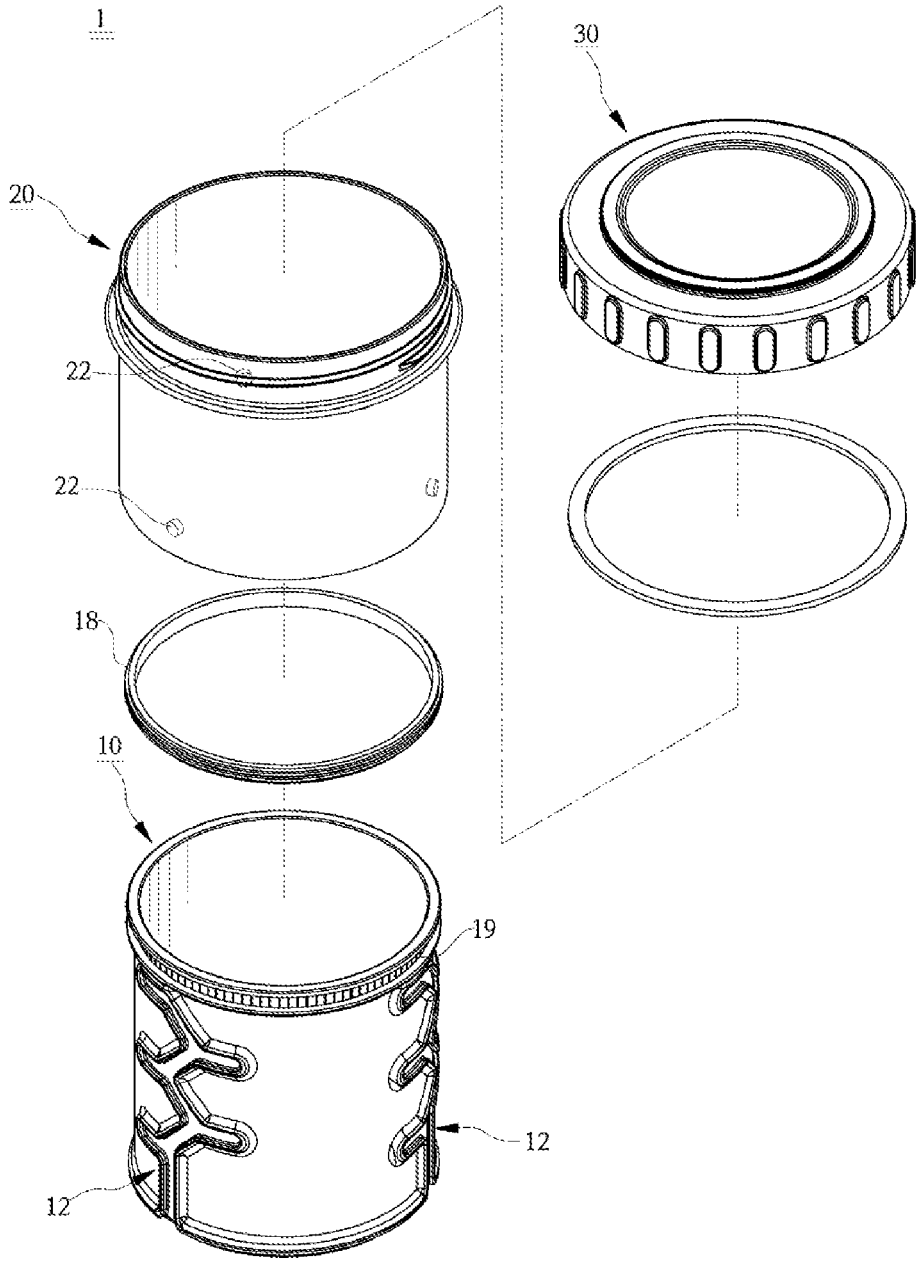
FIG.1 (PRIOR ART)
FIG. 1 is a perspective view showing a conventional container adjustable in height.
Figure 2:
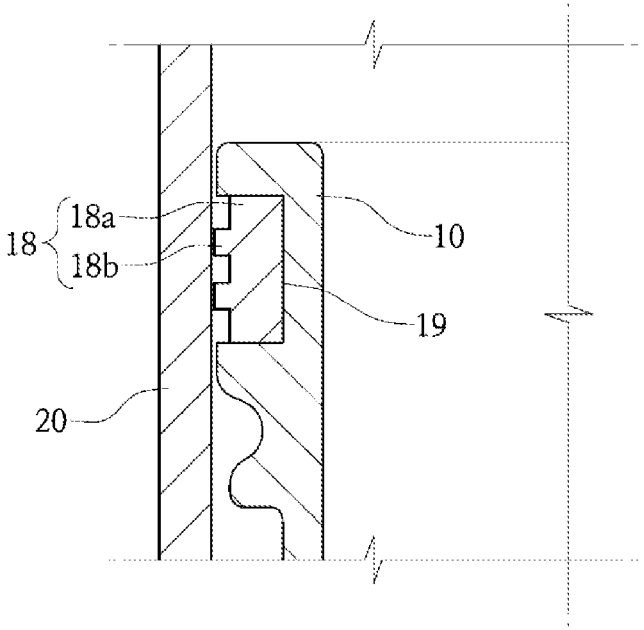
FIG.2 (PRIOR ART)
FIG. 2 is a sectional view showing a specific structure of a packing member applied to the conventional container adjustable in height.

100, 101, 102-1, 102-2: first body 101*a*: edge portion
110, 111: concave portion 111*a*: fitting concave portion
200, 201, 202, 203, 204: second body 212: second edge portion
300: first packing
310: first tight contact portion, 320, 321: first extension portion
322: first top extension portion, 322*a*: first vertical extension portion
324: first underside extension portion, 326, 327: connection portion
330, 332: first protrusion portion, 340: support protrusion
350: first auxiliary contact protrusion, 352: scrab portion
360: auxiliary protrusion
400: second packing
410: second tight contact portion, 420: second extension portion
422: second top extension portion, 422*a*: second vertical extension portion
424: second underside extension portion, 424*a*: convex portion
430: second protrusion portion, 440: connection portion
450: second auxiliary contact protrusion

BEST MODE FOR INVENTION

Hereinafter, an explanation of a packing structure according to the present invention will be given in detail with reference to the attached drawings.

Figure 3:
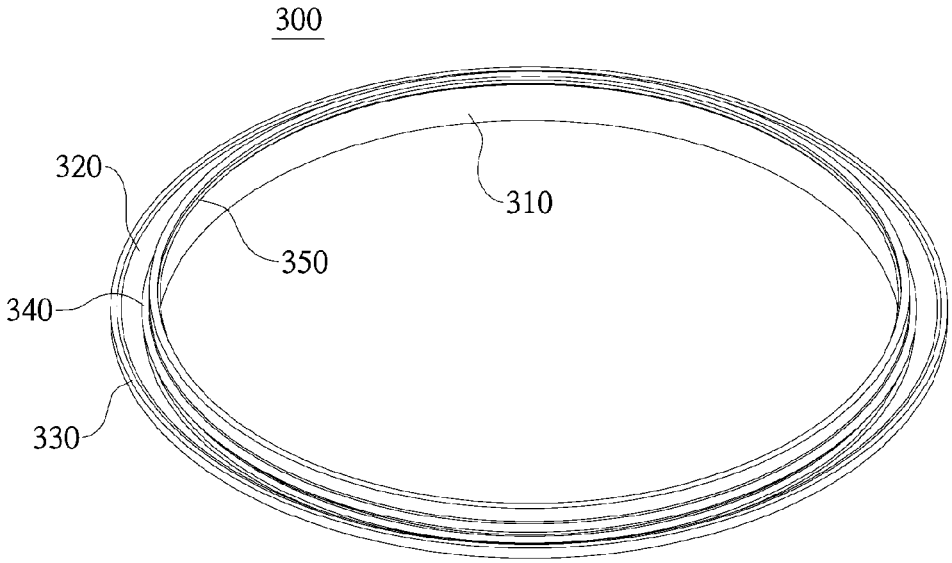
FIG. 3 is a schematic perspective view showing a packing structure according to a first embodiment of the present invention.
Figure 4:
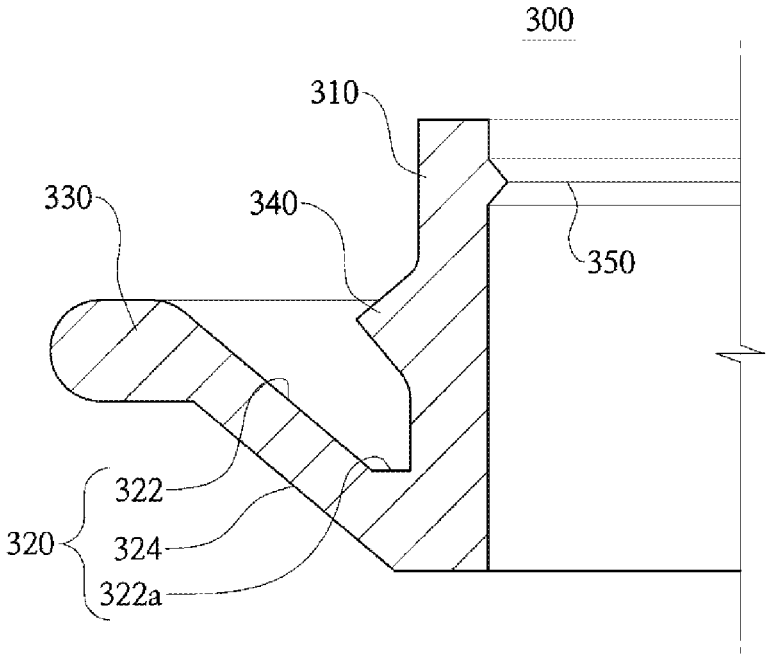
FIG. 4 is a schematic sectional view showing the packing structure according to the first embodiment of the present invention.

FIG. 3 is a schematic perspective view showing a packing structure according to a first embodiment of the present invention, and FIG. 4 is a schematic sectional view showing the packing structure according to the first embodiment of the present invention.

Figure 5:
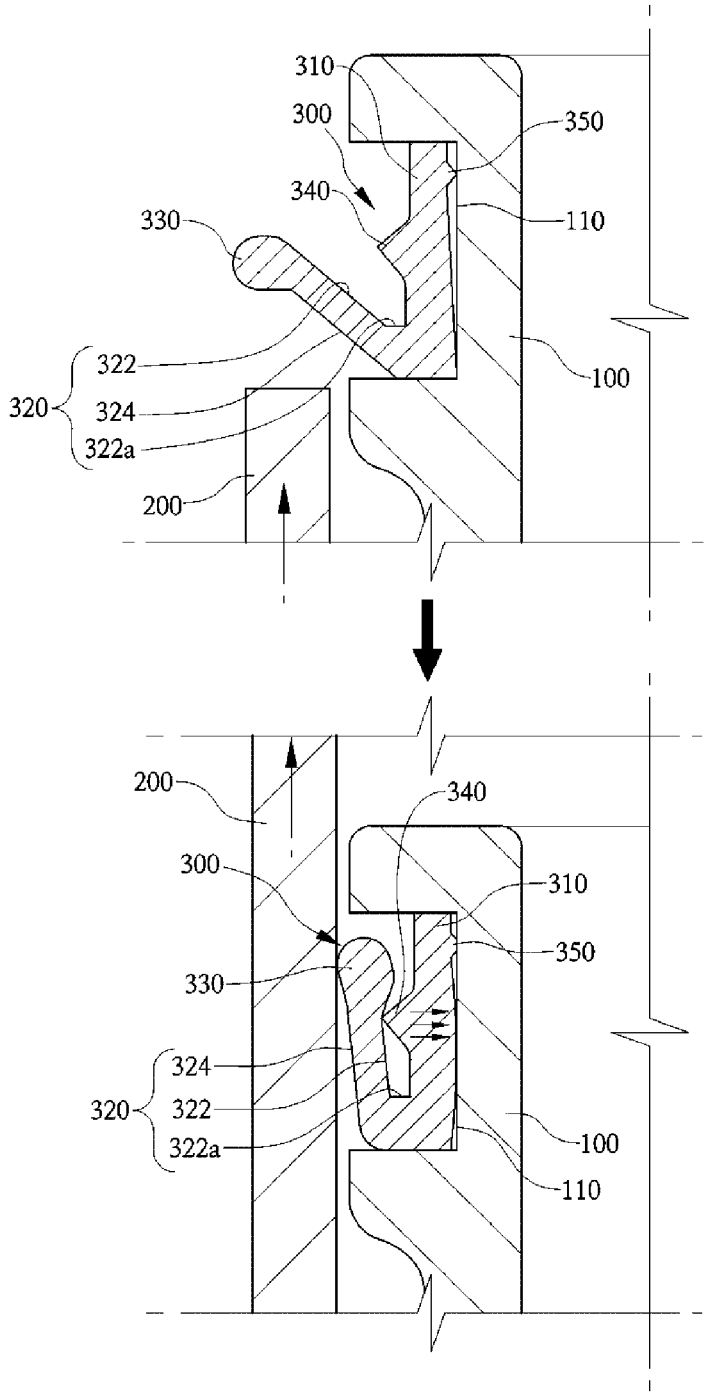
FIG. 5 is a sectional view showing a state where a first packing is pressurized against a second body moving upward in the packing structure according to the first embodiment of the present invention.

Referring to FIGS. 3 and 4, a packing structure according to a first embodiment of the present invention includes a first packing 300 disposed between a first body 100 (See FIG. 5) and a second body 200 (See FIG. 5).

The first body 100 and the second body 200 constitute a container in which a given content like food or food material is stored, and the first body 100 has a cylindrical shape and accommodates the food or food material put through open bottom portion thereof. An inner diameter of the second body 200 is larger than an outer diameter of the first body 100, and the second body 200 inserts the first body 100 thereinto through open bottom portion thereof. Further, the first body 100 has a concave portion 110 (See FIG. 5) formed along the outer periphery thereof in such a manner as to insert a first tight contact portion 310 as will be discussed later thereinto. The first and second bodies 100 and 200 have the similar functions and structures to the first and second bodies 10 and 20 as shown in FIG. 1, and the second body 200 further includes a cap (not shown) for opening and closing the top open thereof. Also, the present invention is not limited to the above-mentioned structure, and in some cases, the second body serves as a typical cap. In this case, the second body is fixed to the first body in the state where top of the second body is closed. In this case, the concave portion is formed along the top end periphery of the first body in such a manner as to be covered with the closed top of the second body.

According to the first embodiment of the present invention, on the other hand, the first and second bodies 100 and 200 have circular horizontal section shapes, but of course, they are not limited thereto. In some cases, they may have polygonal or oval horizontal section shapes.

The first packing 300 is made of a material having water tightness and elasticity like synthetic rubber, silicone, and so on and includes the first tight contact portion 310 inserted into the concave portion 110 formed on the outer periphery of the first body 100 in a state where the first body 100 is inserted into the second body 200, a first extension portion 320 extended inclined upward from the outer periphery of the first tight contact portion 310 toward the opposite direction to the first body 100, and a first protrusion portion 330 protruding from the outer periphery of the first extension portion 320 toward the inner periphery of the second body 200.

The first tight contact portion 310 has the shape of a ring, and the inner periphery of the first tight contact portion 310 coming into contact with the first body 100 is flattened in such a manner as to come into close contact with the concave portion 110 of the first body 100.

Referring to the specific shape of the first extension portion 320, the first extension portion 320 includes a first top extension portion 322 formed inclinedly in such a manner as to allow top end periphery thereof to be connected to the first protrusion portion 330 and to allow bottom end periphery thereof to be extended toward the bottom periphery of the first tight contact portion 310 and a first underside extension portion 324 formed inclinedly on the underside of the first top extension portion 322. Further, the first extension portion 320 includes a first vertical extension portion 322*a* extended unitarily from the bottom periphery of the first top extension portion 322 connected to the first tight contact portion 310 in such a manner as to be vertical with respect to the first tight contact portion 310. In this case, the bottom end periphery of the first tight contact portion 310 is connected unitarily to the first underside extension portion 324 in such a manner as to be bent by the inclined angle of the first underside extension portion 324. In specific, the bottom end periphery of the first top extension portion 322 is vertically connected unitarily to the first tight contact portion 310 by means of the first vertical extension portion 322*a*, and the first underside extension portion 324 is inclinedly connected unitarily to the bottom end periphery of the first tight contact portion 310.

The first protrusion portion 330 is bendedly extended from the first extension portion 320 in such a manner as to come into close contact with the inner periphery of the second body 100, thereby making a force for pushing an external pressure generated from the second body 200 stronger. Accordingly, the first protrusion portion 330 and the second body 200 always come into tight contact with each other, so that the first protrusion portion 330 is not arbitrarily separated from the second body 200, thereby providing a tight sealing force.

Further, the first packing 300 includes a support protrusion 340 protruding from the outer periphery of the first tight contact portion 310 facing the first extension portion 320 toward the first extension portion 320. For example, the support protrusion 340 has a triangular section shape, but according to the present invention, of course, the support protrusion 340 is not limited thereto.

Furthermore, the first packing 300 includes an auxiliary contact protrusion 350 protruding from the inner periphery of the first tight contact portion 310. When the first extension portion 320 protrudes from the outer bottom periphery of the first tight contact portion 310, the auxiliary contact protrusion 350 protrudes from the inner top periphery of the first tight contact portion 310.

FIG. 5 is a sectional view showing a state where the first packing is pressurized against the second body moving upward in the packing structure according to the first embodiment of the present invention.

Referring to FIG. 5, if the second body 200 moves upward in a state where the first body 100 is inserted into the second body 200, the first protruding portion 330 comes into close contact with the second body 200 in such a manner as to be elastically deformed toward the first body 100. In this case, the support protrusion 340 is pressurized against the first extension portion 320 to allow the first tight contact portion 310 to be pressurized toward the first body 100. Like this, the first tight contact portion 310 applies a strong pressure to the concave portion 110 of the first body 100 by means of the support protrusion 340, so that a gap between the first tight contact portion 310 and the concave portion 110 can be tightly sealed.

Since the support protrusion 340 allows the first extension portion 320 to be pressurized against the second body 200, further, a gap between the first protrusion portion 330 connected to the first extension portion 320 and the second body 200 can be tightly sealed. Even if time passes, also, the elastic force or returning force of the support protrusion 340 is not deteriorated, so that the elastic force or returning force is consistently maintained for a long time. Further, the support protrusion 340 has the shape of the ring formed along the outer periphery of the first tight contact portion 310, so that even if the first extension portion 320 is partially twisted by means of the pressurization of the second body 200, the support protrusion 340 can firmly pressurize the first extension portion 320.

Moreover, one side periphery of the first vertical extension portion 322*a* is connected vertically to the first tight contact portion 310. Even if a pressure is applied from the second body 200 to the first vertical extension portion 322*a*, accordingly, the first vertical extension portion 322*a* is not deformed in shape, so that the first top extension portion 322 connected to the other side periphery of the first vertical extension portion 322*a* is elastically kept spaced apart from the first tight contact portion 310 to allow the first protrusion portion 330 connected unitarily to the first top extension portion 322 and the first underside extension portion 324 to be kept to a state of coming into tight contact with the inner periphery of the second body 200, thereby tightly sealing the gap between the first protrusion portion 330 and the second body 200.

On the other hand, the end periphery of the first protrusion portion 330 is rounded, and accordingly, the first protrusion portion 330 has line contact with the inner periphery of the second body 200, thereby allowing the contact area to be relatively small and allowing a frictional force therebetween to be small, so that when the second body 200 moves downward, the first protrusion portion 330 does not turn over. This will be described with reference to FIG. 8 later.

Figure 6:
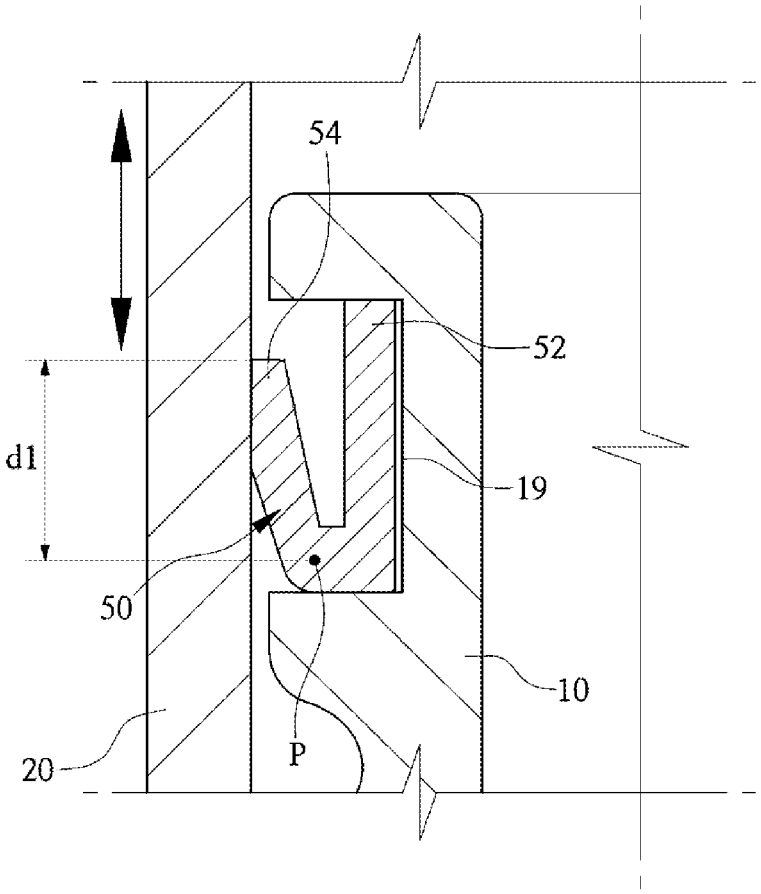
FIG. 6 is a sectional view showing an example of a first packing in conventional practice.
Figure 7:
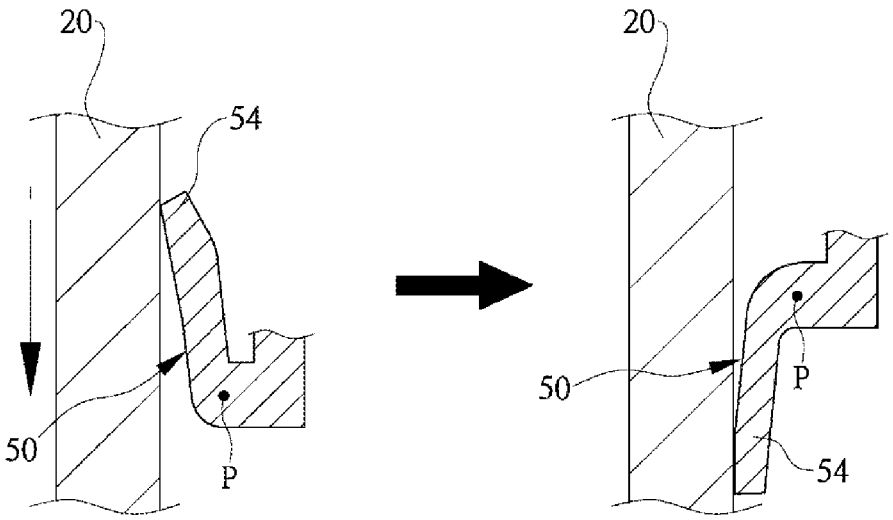
FIG. 7 is a sectional view showing a state where the first packing in the conventional practice turns over by means of a second body.

FIG. 6 is a sectional view showing an example of a first packing in conventional practice, and FIG. 7 is a sectional view showing a state where the first packing in the conventional practice turns over by means of a second body.

Referring to FIGS. 6 and 7, a first packing 50 includes a contact portion 52 coming into close contact with the inner periphery of the first body 10 and an inclined portion 54 protruding inclinedly upward from the bottom periphery of the contact portion 52. The inclined portion 54 has a first length d1 and an imaginary support axis P located at the bottom end periphery connected to the first body 10.

The inclined portion 54 is formed inclinedly with respect to the contact portion 52, and if a pressure is applied from the second body 20 moving downward to the inclined portion 54, accordingly, the top end periphery of the inclined portion 54 is deformed in shape by means of its own elasticity and thus moves toward the first body 10. As the support force of the inclined portion 54 is not sufficient, in this case, the inclined portion 54 turns over in a downward direction around the support axis P located at the bottom end periphery thereof.

In this case, the reason why the inclined portion turns over is as follows: firstly, the top end periphery of the inclined portion 54 has surface contact with the second body 200 to cause the contact area to be large, thereby increasing a frictional force therebetween, and secondly, the first length d1 between the top end periphery of the inclined portion 54 and the support axis P is relatively long. Generally, the longer a length is, the larger elastic deformation occurs, and if a downward pressure is applied to the inclined portion 54, accordingly, the elastic force of the inclined portion 54 does not support the downward pressure, so that the inclined portion 54 turns over by means of the downward pressure.

Figure 8:
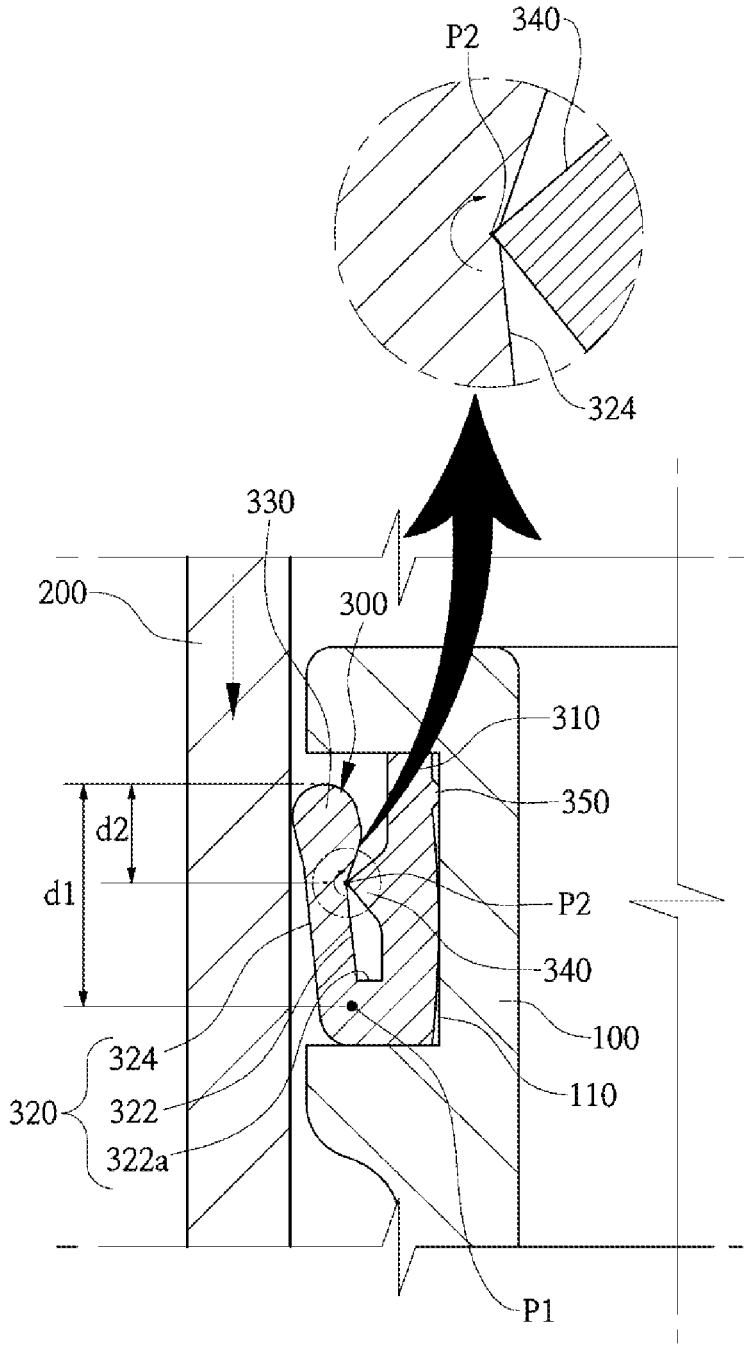
FIG. 8 is a sectional view showing a state where the first packing is pressurized against the second body moving downward in the packing structure according to the first embodiment of the present invention.

FIG. 8 is a sectional view showing a state where the first packing is pressurized against the second body moving downward in the packing structure according to the first embodiment of the present invention.

Referring to FIG. 8, if the second body 200 moves downward in a state where the first body 100 is inserted into the second body 200, the first protrusion portion 330 comes into close contact with the second body 200. In this case, the end periphery of the first protrusion portion 330 has the rounded semicircular shape, and accordingly, the first protrusion portion 330 has the line contact with the second body 200 to allow the frictional force therebetween to be small, so that the first protrusion portion 330 does not turn over when the second body 200 moves downward.

The first top extension portion 322 of the first extension portion 320 comes into close contact with the support protrusion 340 by means of the pressurization of the second body 200, and in this case, a point of the first top extension portion 322 coming into close contact with the support protrusion 340 is defined as a first pressurization point P2. If the first pressurization point P2 is pressurized against the support protrusion 340, it becomes concave inward from the first extension portion 320 by means of the pressurization of the support protrusion 340. In this state, if the second body 200 moves downward, the downward pressure is applied to the top end periphery of the first extension portion 320 coming into close contact with the second body 200, but since the first pressurization point P2 is supported against the support protrusion 340, the top end periphery of the first extension portion 320 is firmly supported, without any downward deformation. More specifically, a first length d1 from the support axis P1 located on the bottom end periphery of the first extension portion 320 to the top end periphery of the first protrusion portion 330 is longer than a second length d2 from the first pressurization point P2 to the top end periphery of the first protrusion portion 330. Further, since the first pressurization point P2 is pressurized against the support protrusion 340, a rotary axis used to allow the first extension portion 320 to turn over is changed to the first pressurization point P2, not to the support axis P1. Like this, in a state where the rotary axis of the first extension portion 320 is changed to the first pressurization point P2, structurally, only the corresponding portion to the second length d2 of the first extension portion 320 can rotate. However, the corresponding portion to the second length d2 is too short to rotate, and the shorter the length is, the larger the elastic deformation is, so that the first extension portion 320 can be prevented from turning over.

Figure 9:
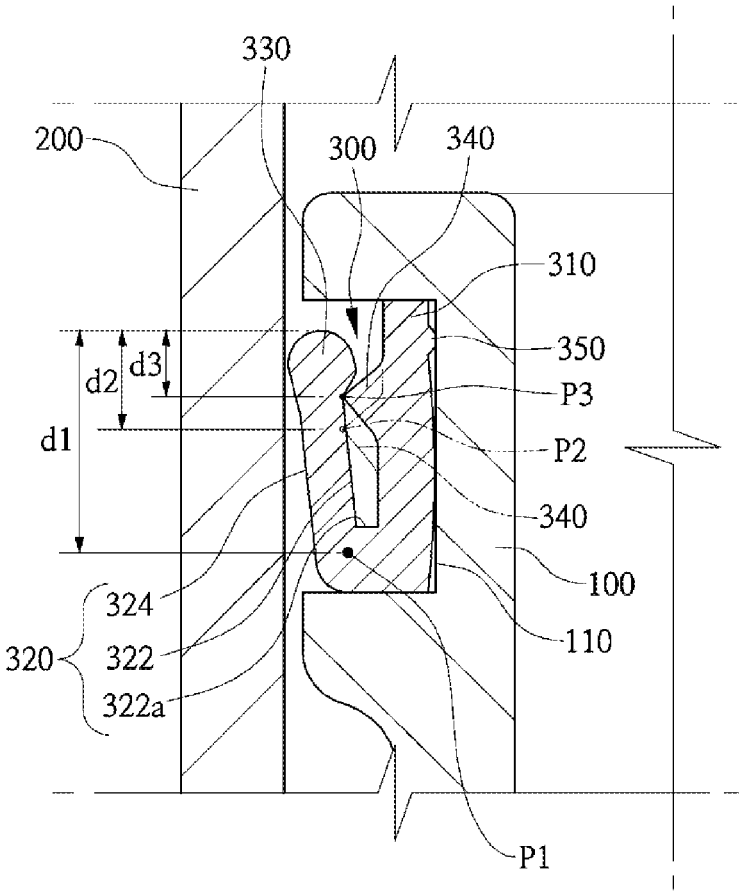
FIG. 9 is a sectional view showing another state where the first packing is pressurized against the second body moving downward in the packing structure according to the first embodiment of the present invention.

FIG. 9 is a sectional view showing another state where the first packing is pressurized against the second body moving downward in the packing structure according to the first embodiment of the present invention.

Referring to FIGS. 8 and 9, the support protrusion 340 as shown in FIG. 9 is formed higher than the support protrusion 340 as shown in FIG. 8, and a point of the first top extension portion 322 coming into close contact with the support protrusion 340, that is, a second pressurization point P3 is located higher than the first pressurization point P2 as shown in FIG. 8. Accordingly, a third length d3 from the second pressurization point P3 to the top end periphery of the first protrusion portion 330 is shorter than the second length d2. In this case, the portion corresponding to the third length d3 is too short to rotate the first extension portion 320, so that as the support protrusion 340 is formed higher on the outer periphery of the first tight contact portion 310, the first extension portion 320 cannot turn over at all.

Figure 10:
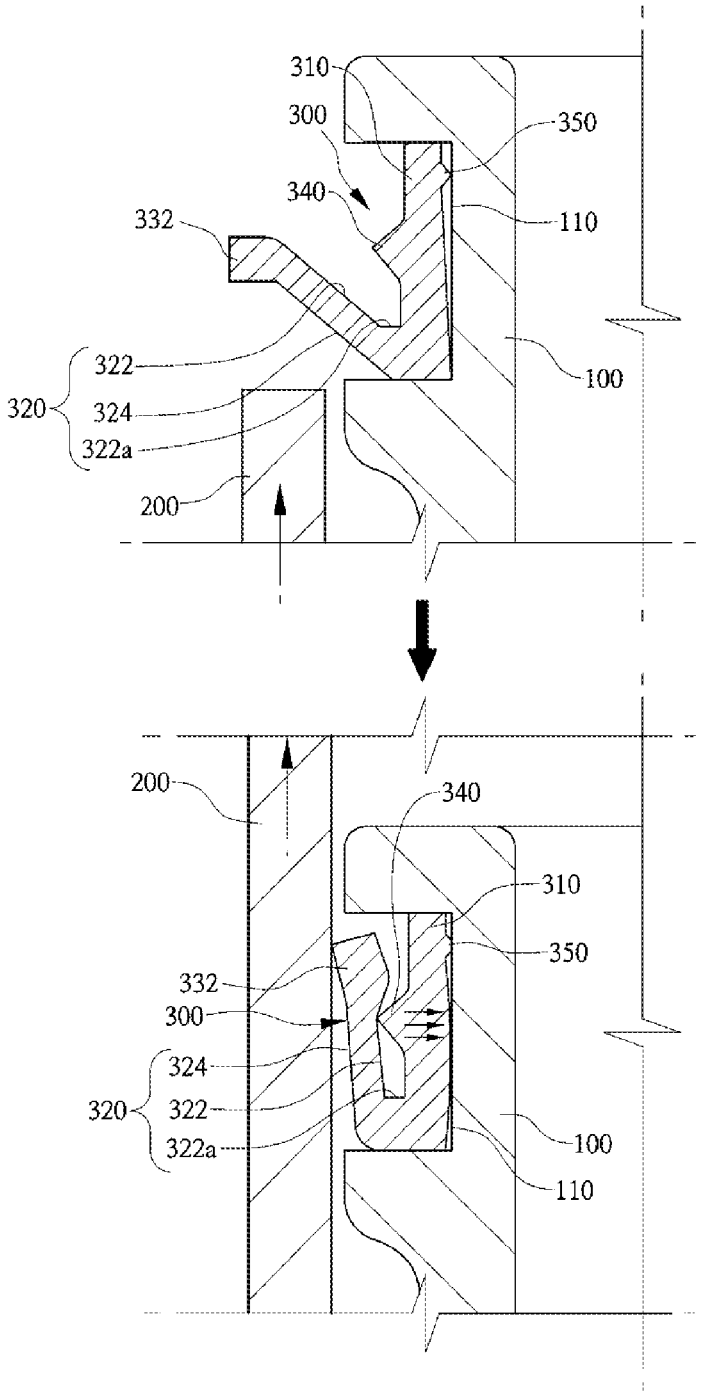
FIG. 10 is a sectional view showing another example of a first protrusion portion protruding from the first packing of the packing structure according to the first embodiment of the present invention.

FIG. 10 is a sectional view showing another example of the first protrusion portion protruding from the first packing of the packing structure according to the first embodiment of the present invention.

Referring to FIG. 10, the edge periphery of a first protrusion portion 332 is angled. If the second body 200 moves downward in a state where the first body 100 is inserted into the second body 200, accordingly, the edge periphery of the first protrusion portion 332 has line contact with the second body 200 to allow the frictional force therebetween to be small, so that the first protrusion portion 330 does not turn over when the second body 200 moves downward.

Figure 11:
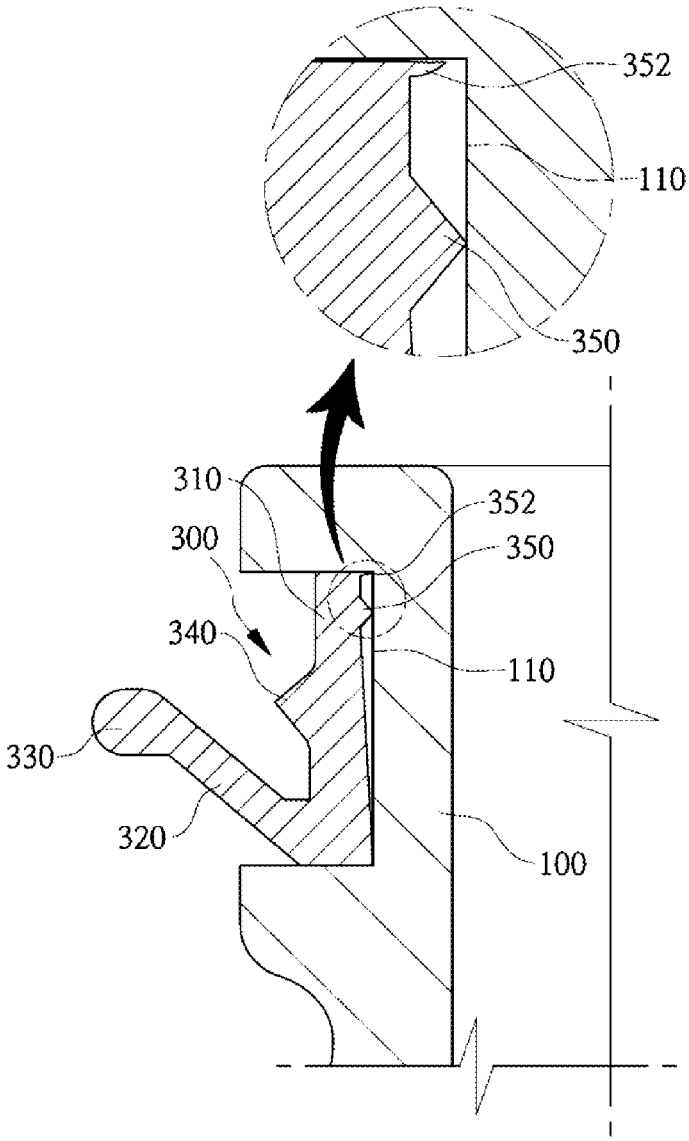
FIG. 11 is a sectional view showing an auxiliary contact protrusion of the first packing of the packing structure according to the first embodiment of the present invention.

FIG. 11 is a sectional view showing an auxiliary contact protrusion protruding from the first packing of the packing structure according to the first embodiment of the present invention.

Referring to FIG. 11, the first packing 300 is made by injecting resin into a mold through typical injection molding, and in the process of the injection molding, a scrab portion 352 unnecessarily protrudes from the first tight contact portion 310 of the first packing 300. Even in a process of other molding like press molding, the scrab portion 352 unnecessarily protrudes from the first tight contact portion 310 of the first packing 300. As the scrab portion 352 is irregularly formed, a gap may be formed between the first tight contact portion 310 and the first body 100.

According to the present invention, an auxiliary contact protrusion 350 protrudes from the upper inner periphery of the first tight contact portion 310 in such a manner as to have a length longer than a protruding length of the scrab portion 352. If the first tight contact portion 310 is inserted into the concave portion 110, accordingly, the auxiliary contact protrusion 350 uniformly protruding, not the scrab portion 352 irregularly protruding, comes into tight contact with the concave portion 110, so that a gap between the inner periphery of the first tight contact portion 310 and the concave portion 110 can be tightly sealed.

Further, the auxiliary contact protrusion 350 enables the inner periphery of the first tight contact portion 310 and the concave portion 110 to be separated from each other by the protruding length thereof, irrespective of the scrab portion 352. As a result, the upper inner periphery of the first tight contact portion 310 is elastically bent, and through the reaction to the elastic bending, an elastic pressure is applied from the lower inner periphery of the first tight contact portion 310 to the concave portion 110. Like this, if so, the gap between the inner periphery of the first tight contact portion 310 and the concave portion 110 can be tightly sealed.

On the other hand, as the auxiliary contact protrusion 350 protruding from the upper inner periphery of the first tight contact portion 310 becomes close to the top inner periphery of the first tight contact portion 310, that is, as the auxiliary contact protrusion 350 is formed higher on the inner periphery of the first tight contact portion 310, the first tight contact portion 310 is located stably in the concave portion 110, without any movement, so that if the auxiliary contact protrusion 350 is formed higher on the first tight contact portion 310, the gap between the inner periphery of the first tight contact portion 310 and the concave portion 110 can be more tightly sealed.

Figure 12:
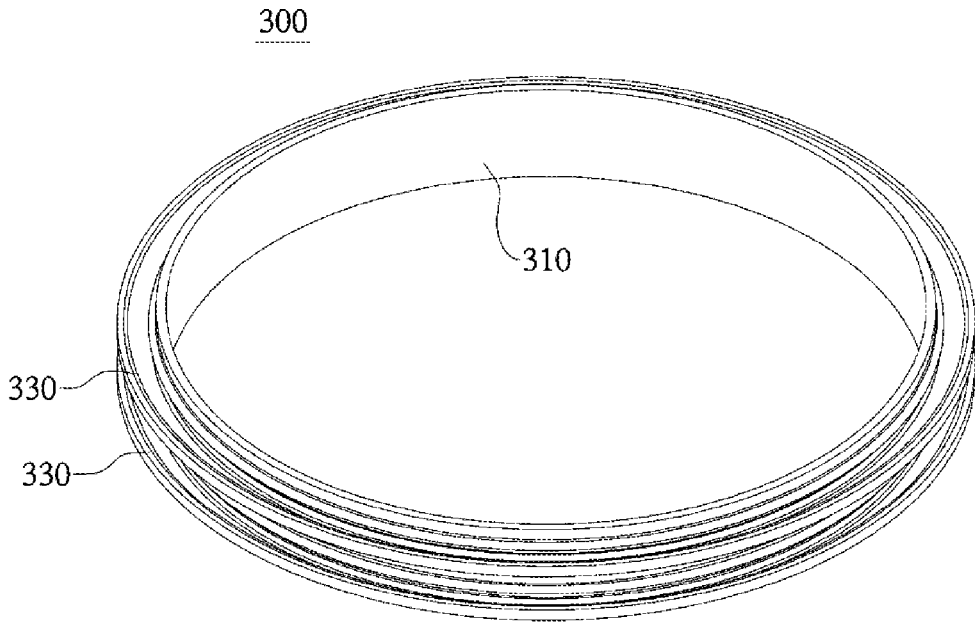
FIG. 12 is a perspective view showing another example of the first packing of the packing structure according to the first embodiment of the present invention.
Figure 13:
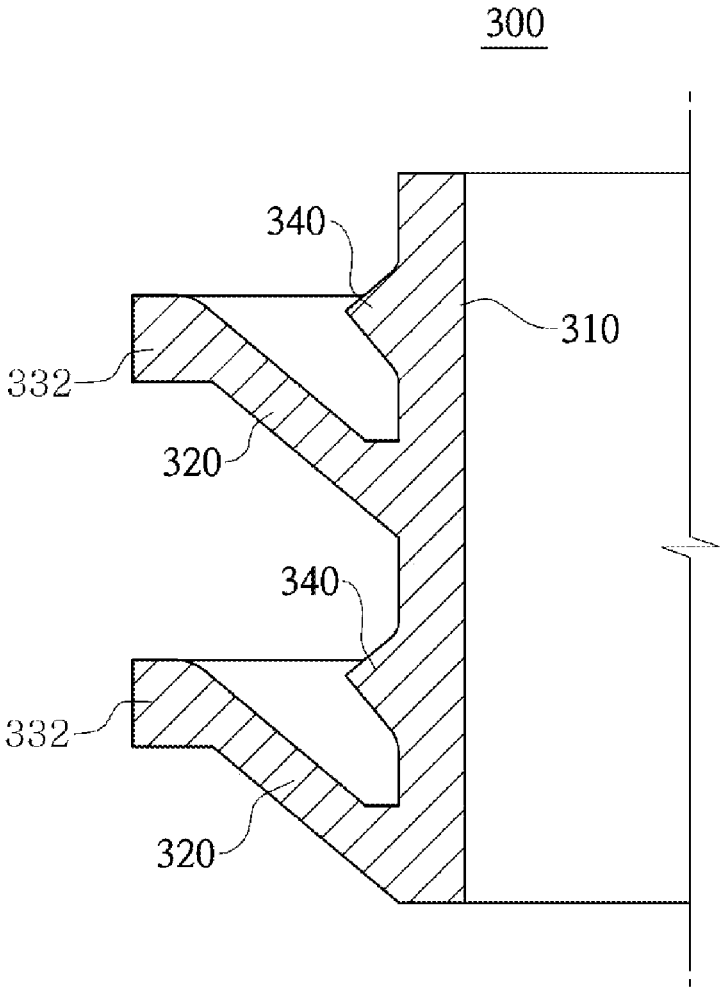
FIG. 13 is a sectional view showing yet another example of the first packing of the packing structure according to the first embodiment of the present invention.

FIG. 12 is a perspective view showing another example of the first packing of the packing structure according to the first embodiment of the present invention, and FIG. 13 is a sectional view showing yet another example of the first packing of the packing structure according to the first embodiment of the present invention.

Referring to FIGS. 12 and 13, the first packing 300 has a plurality of first extension portions 320 protruding from the outer periphery of the first tight contact portion 310, for example, has a pair of first extension portions 320 protruding therefrom in parallel to each other. First protrusion portions 332 protrude from the respective first extension portions 320, and support protrusions 340 protrude from the first tight contact portion 310 in such a manner as to face the respective first extension portions 320. In this case, the end periphery of each support protrusion 340 is angled to a right angle, not rounded.

According to the present invention, like this, the plurality of first extension portions 320, the first protrusion portions 332, and the support protrusions 340 are provided, so that the gap between the first body 100 and the second body 200 can be more tightly sealed.

Figure 14:
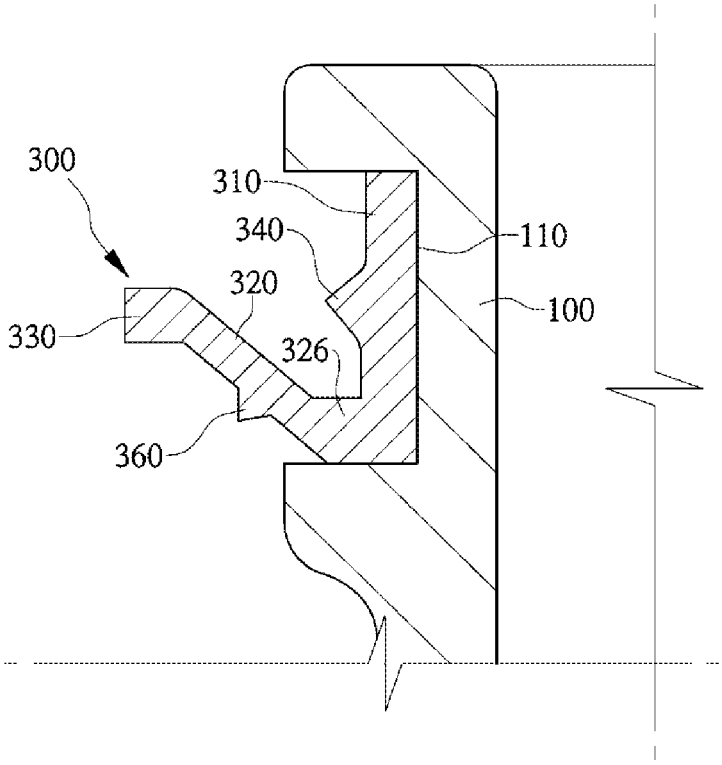
FIG. 14 is a sectional view showing still another example of the first packing of the packing structure according to the first embodiment of the present invention.
Figure 15:
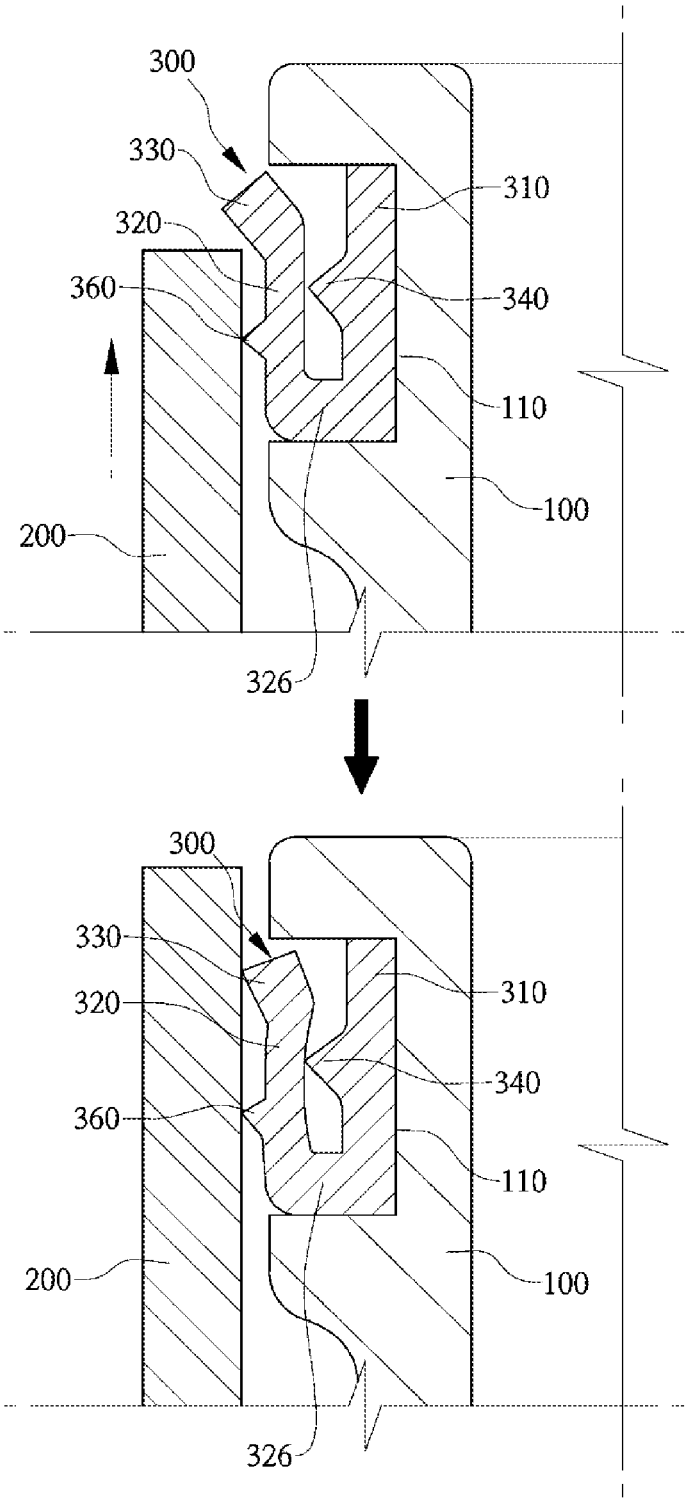
FIG. 15 is a sectional view showing a state where the first packing is pressurized against the second body in the packing structure according to the first embodiment of the present invention.

FIG. 14 is a sectional view showing still another example of the first packing of the packing structure according to the first embodiment of the present invention, and FIG. 15 is a sectional view showing a state where the first packing is pressurized against the second body in the packing structure according to the first embodiment of the present invention.

Referring to FIGS. 14 and 15, the first packing 300 includes the first close contact portion 310, the first extension portion 320, the first protrusion portion 330, the support protrusion 340, a connection portion 326, and an auxiliary protrusion 360. Since the first packing 300 including the first close contact portion 310, the first extension portion 320, the first protrusion portion 330, and the support protrusion 340 have been already explained, and accordingly, an explanation of the connection portion 326 and the auxiliary protrusion 360 will be given below.

The connection portion 326 vertically protrudes unitarily from the lower periphery of the first tight contact portion 310. The lower side periphery of the first extension portion 320 is connected unitarily to the outer periphery of the connection portion 326. The auxiliary protrusion 360 protrudes from the outer periphery of the first extension portion 320 that does not face the first tight contact portion 310. The auxiliary protrusion 360 has a triangular section shape so that it has sharp end periphery, but according to the present invention, of course, the auxiliary protrusion 360 is not limited thereto. In some cases, the auxiliary protrusion 360 may have various section shapes like a polygonal or circular section shape.

If the second body 200 moves upward in a state where the first body 100 is inserted into the second body 200, the first protrusion portion 330 comes into close contact with the second body 200 and is elastically deformed toward the first body 100. In this case, the inner periphery of the first extension portion 320 comes into contact with the support protrusion 340, and accordingly, the gap between the inner periphery of the first extension portion 320 and the support protrusion 340 is kept tight. Further, if the first extension portion 320 is elastically deformed toward the first tight contact portion 310 by means of the pressure applied from the inner periphery of the second body 200 to the auxiliary protrusion 360, the auxiliary protrusion 360 comes into tight contact with the inner periphery of the second body 200. Furthermore, if the first protrusion portion 330 is elastically deformed toward the first tight contact portion 310 by means of the pressure applied from the inner periphery of the second body 200 coming into contact with the first protrusion portion 330 to the first protrusion portion 330, the end periphery of the first protrusion portion 330 comes into tight contact with the inner periphery of the second body 200. In this case, a thickness of the first protrusion portion 330 is larger than that of the first extension portion 320, and accordingly, the first protrusion portion 330 has a stronger elastic force than the first extension portion 320, so that even if time passes, the end periphery of the first protrusion portion 330 can be maintained to a state of coming into close contact with the inner periphery of the second body 200 for a long time.

According to the present invention, like this, the auxiliary protrusion 360 and the first protrusion portion 330 come into tight contact with the inner periphery of the second body 200, so that the gap between the second body 200 and the first extension portion 320 can come into tight contact with each other, doubly, by means of the auxiliary protrusion 360 and the first protrusion portion 330. Further, as the support protrusion 340 is formed between the auxiliary protrusion 360 and the first protrusion portion 330, it can firmly support the auxiliary protrusion 360 and the first protrusion portion 330 against the second body 200.

Figure 16A:
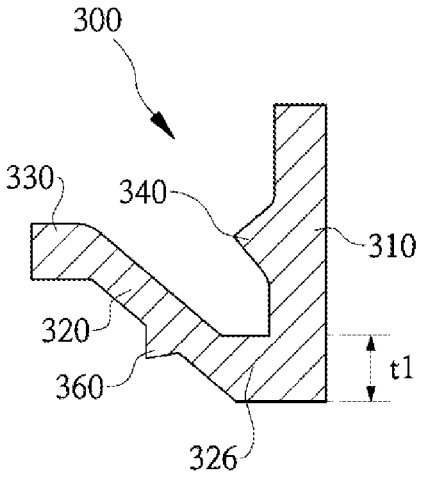
FIGS. 16A and 16B are sectional views showing other examples of the first packing of the packing structure according to the first embodiment of the present invention.
Figure 16B:
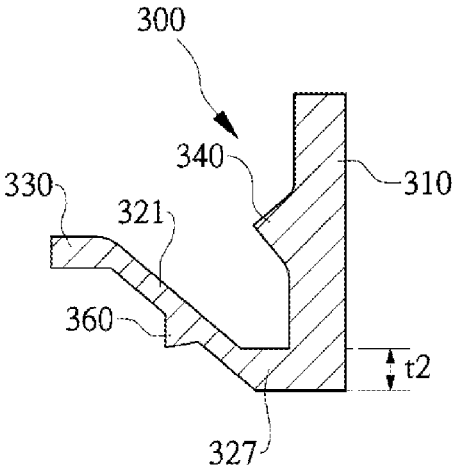
Figure 17:
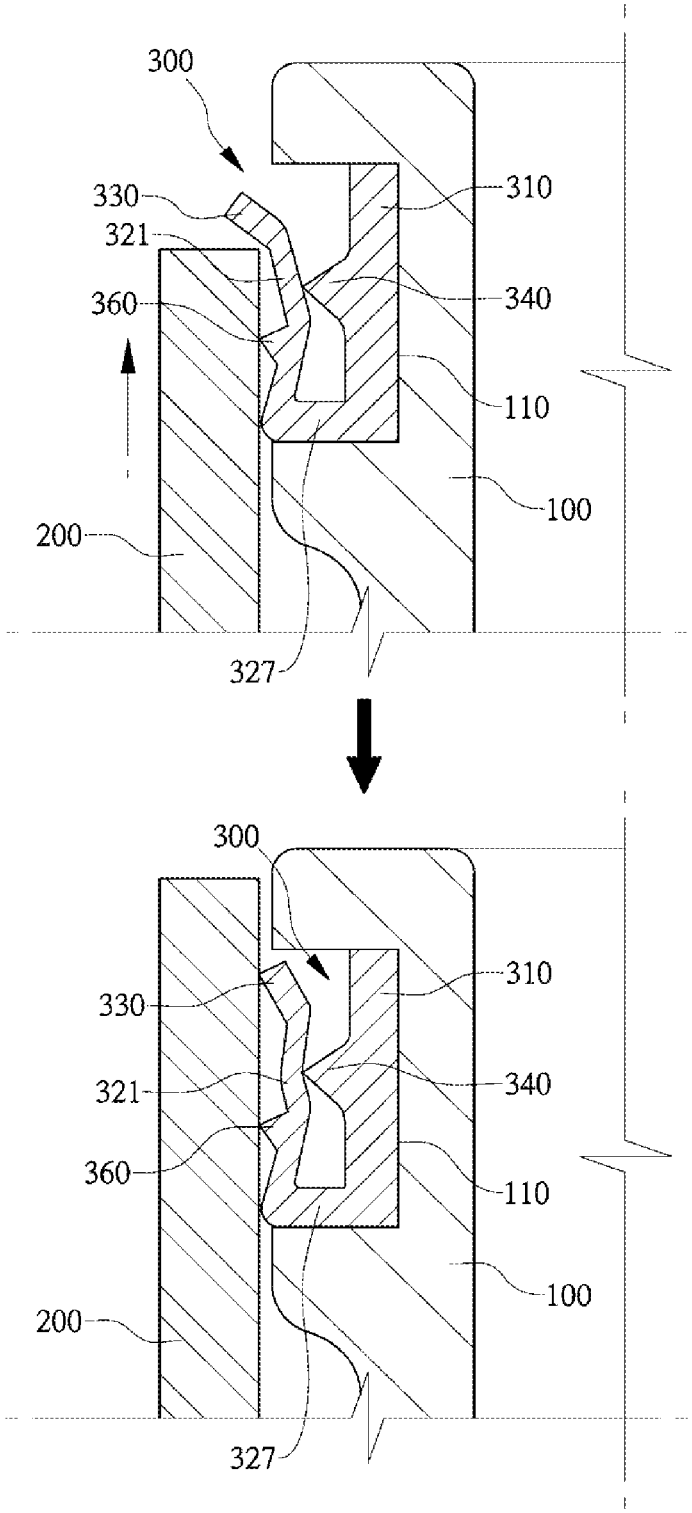
FIG. 17 is a sectional view showing a state where the first packing is pressurized against the second body in the packing structure according to the first embodiment of the present invention.

FIGS. 16A and 16B are sectional views showing other examples of the first packing of the packing structure according to the first embodiment of the present invention, and FIG. 17 is a sectional view showing a state where the first packing is pressurized against the second body in the packing structure according to the first embodiment of the present invention.

Referring first to FIGS. 16A and 16B, a thickness t1 of the connection portion 326 of the first packing 300 as shown in FIG. 16A is larger than a thickness t2 of a connection portion 327 of the first packing 300 as shown in FIG. 16B. If the thickness t2 of the connection portion 327 of the first packing 300 is relatively small, like this, a thickness of a first extension portion 321 connected unitarily to the connection portion 327 becomes also small, and accordingly, the strength of the first extension portion 321 becomes low, so that the first extension portion 321 may be elastically deformed in shape easily.

Referring next to FIG. 17, if the second body 200 moves upward in a state where the first body 100 is inserted into the second body 200, the first extension portion 321 is elastically deformed toward the first tight contact portion 310 by means of the pressure applied to the auxiliary protrusion 360 from the inner periphery of the second body 200 coming into contact with the auxiliary protrusion 360. In this case, since the thickness of the first extension portion 321 is relatively small, the lower periphery of the first extension portion 321 along which the auxiliary protrusion 360 is formed is elastically deformed and is thus bent toward the gap between the connection portion 327 and the support protrusion 340. In this case, a force of returning to a state of being bent, that is, to the second body 200 is applied to the first extension portion 321 by means of its elastic force, so that the auxiliary protrusion 360 connected to the first extension portion 321 can come into contact with the second body 200 more tightly.

Figure 18:
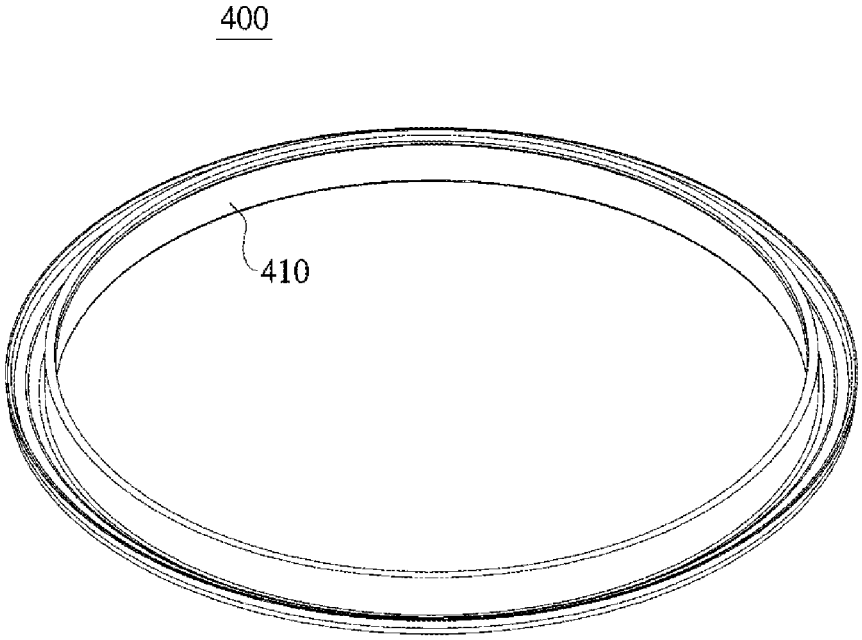
FIG. 18 is a schematic perspective view showing a packing structure according to a second embodiment of the present invention.
Figure 19:
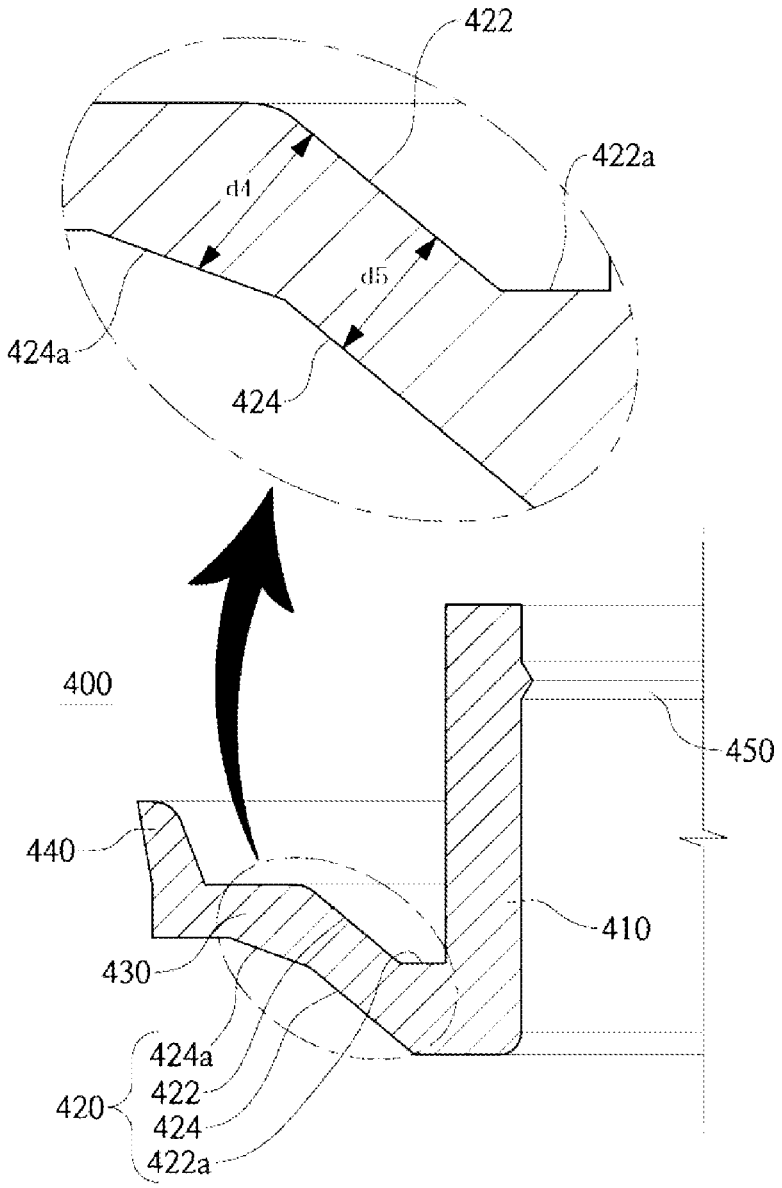
FIG. 19 is a schematic sectional view showing the packing structure according to the second embodiment of the present invention.

FIG. 18 is a schematic perspective view showing a packing structure according to a second embodiment of the present invention, and FIG. 19 is a schematic sectional view showing the packing structure according to the second embodiment of the present invention.

Referring to FIGS. 18 and 19, a packing structure according to a second embodiment of the present invention includes s second packing 400 disposed between a first body 100 and a second body 200.

The first body 100 and the second body 200 are configured in the same structure as in the first embodiment of the present invention. The second packing 400 includes a second tight contact portion 410, a second extension portion 420, a second protrusion portion 430, a contact portion 440, and a second auxiliary contact protrusion 450. The second tight contact portion 410, the second extension portion 420, the second protrusion portion 430, and the second auxiliary contact protrusion 450 are the same as or similar to the first tight contact portion 310, the first extension portion 320, the first protrusion portion 330, and the first auxiliary contact protrusion 350, and a detailed explanation of them will be avoided.

The contact portion 440 protrudes bendedly upward from the end periphery of the second protrusion portion 430. The contact portion 440 becomes inclined as it is distant from the second protrusion portion 430, and the edge periphery between the second protrusion portion 430 and the contact portion 440 is angled or rounded.

The second extension portion 420 includes a second top extension portion 422 formed inclinedly in such a manner as to allow top end periphery thereof to be connected to the second protrusion portion 430 and to allow bottom end periphery thereof to be extended toward the bottom periphery of the second tight contact portion 410 and a second underside extension portion 424 formed inclinedly on the underside of the second top extension portion 422. The second underside extension portion 424 has an extension convex portion 424*a* protruding from the upper periphery thereof in such a manner as to be distant from the second top extension portion 422, and accordingly, a first thickness d4 as a gap between the top periphery of the second top extension portion 422 and the extension concave portion 424*a* is larger than a second thickness d5 as a gap between the bottom periphery of the second top extension portion 422 and the bottom periphery of the second underside extension portion 424. Like this, the top periphery of the second extension portion 420 is thicker than the bottom periphery thereof, and accordingly, the strength of the elastic force of the top periphery of the second extension portion 420 can be stronger than that of the bottom periphery thereof.

Figure 20:
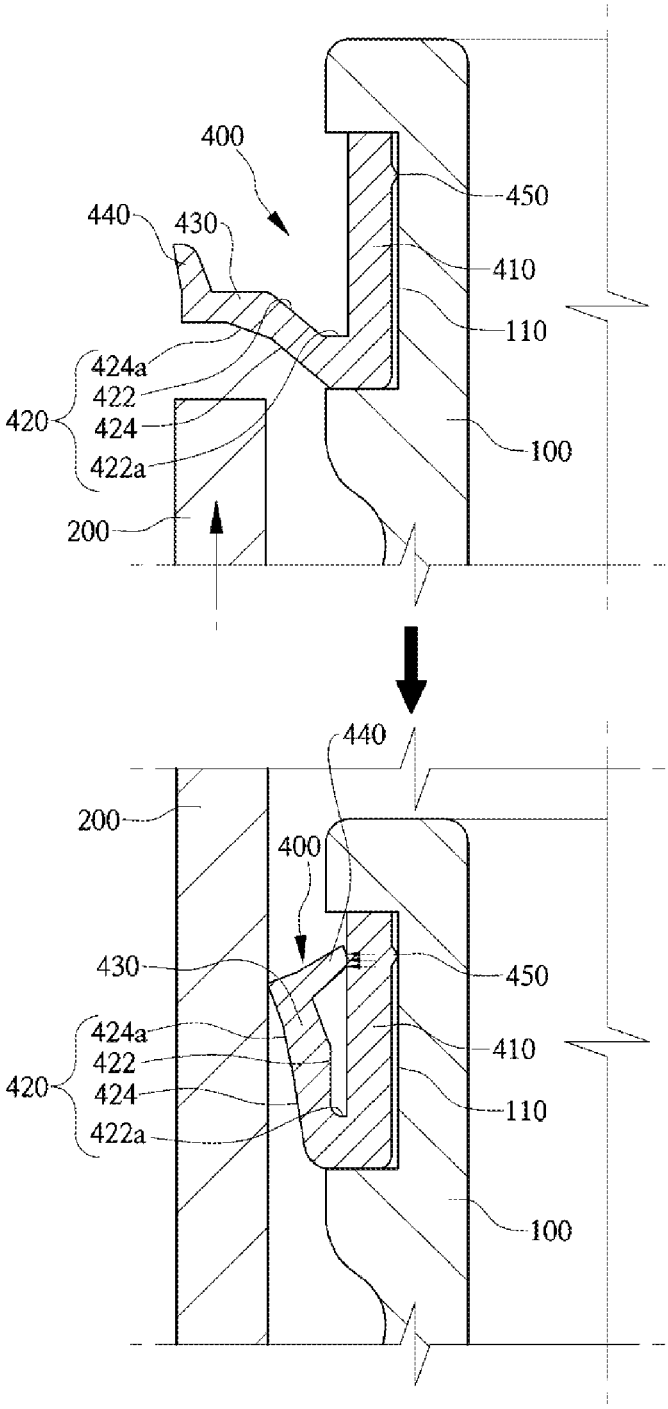
FIG. 20 is a sectional view showing a contact portion formed on a second packing in the packing structure according to the second embodiment of the present invention.

FIG. 20 is a sectional view showing the contact portion formed on the second packing in the packing structure according to the second embodiment of the present invention.

Referring to FIG. 20, if the first body 100 is inserted into the second body 200, the end periphery of the second protrusion portion 430 is elastically deformed upward and thus comes into tight contact with the second body 200, and the contact portion 440 moves toward the second tight contact portion 410 and thus comes into tight contact with the second tight contact portion 410.

In this case, the end periphery of the second protrusion portion 430 has line contact with the second body 200, thereby making a frictional force therebetween small.

Since the contact portion 440 protrudes bendedly from the second protrusion portion 430, further, an empty gap is formed between the second protrusion portion 430 and the contact portion 440, and in this state, if the second body 200 pressurizes the second protrusion portion 430 toward the first body 100, the contact portion 440 is elastically deformed in such a manner as to be distant from the second protrusion portion 430. Through its own tension of the contact portion 440, however, the contact portion 440 pressurizes the second tight contact portion 410 more strongly, so that the gap between the contact portion 440 and the second tight contact portion 410 can be tightly sealed. In the process where the contact portion 440 is elastically deformed toward the second tight contact portion 410, further, additional tension occurs, and accordingly, a pressure is applied from the second protrusion portion 430 to the second body 200, so that the gap between the second protrusion portion 430 and the second body 200 can be tightly sealed. Since a pressure is applied from the contact portion 440 to the second tight contact portion 410, also, the gap between the second tight contact portion 410 and the first body 100 can be tightly sealed.

In this state, if the second body 200 moves downward, the second protrusion portion 430 does not turn over arbitrarily in a downward direction because the frictional force between the second body 200 and the second protrusion portion 430 is small. Since the top periphery of the second extension portion 420 is thicker than the bottom periphery thereof, further, the elastic strength of the top periphery of the second extension portion 420 becomes stronger than that of the bottom periphery thereof, so that the second protrusion portion 430 does not turn over arbitrarily in the downward direction by means of the strong elastic strength of the second extension portion 420.

Figure 21:
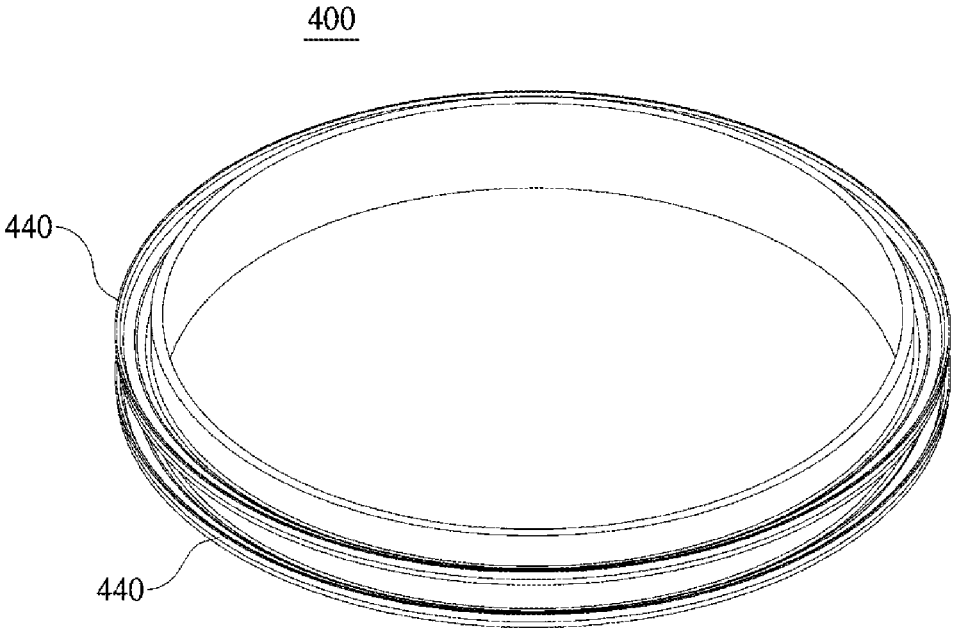
FIG. 21 is a perspective view showing another example of the second packing in the packing structure according to the second embodiment of the present invention.
Figure 22:
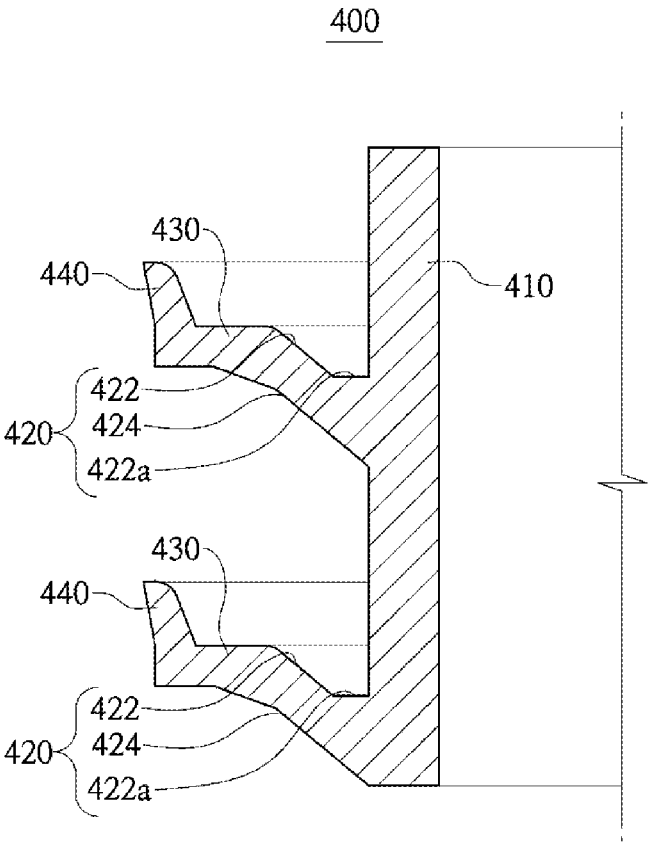
FIG. 22 is a sectional view showing yet another example of the second packing in the packing structure according to the second embodiment of the present invention.

FIG. 21 is a perspective view showing another example of the second packing in the packing structure according to the second embodiment of the present invention, and FIG. 22 is a sectional view showing yet another example of the second packing in the packing structure according to the second embodiment of the present invention.

Referring to FIGS. 21 and 22, the second packing 400 has a plurality of second extension portions 420 protruding from the outer periphery of the second tight contact portion 410, for example, has a pair of second extension portions 420 protruding therefrom in parallel to each other. Second protrusion portions 430 and contact portions 440 protrude from the respective second extension portions 420. According to the present invention, like this, the plurality of second extension portions 420, the second protrusion portions 430, and the contact portions 440 are provided, so that the gap between the first body 100 and the second body 200 can be more tightly sealed.

Figure 23:
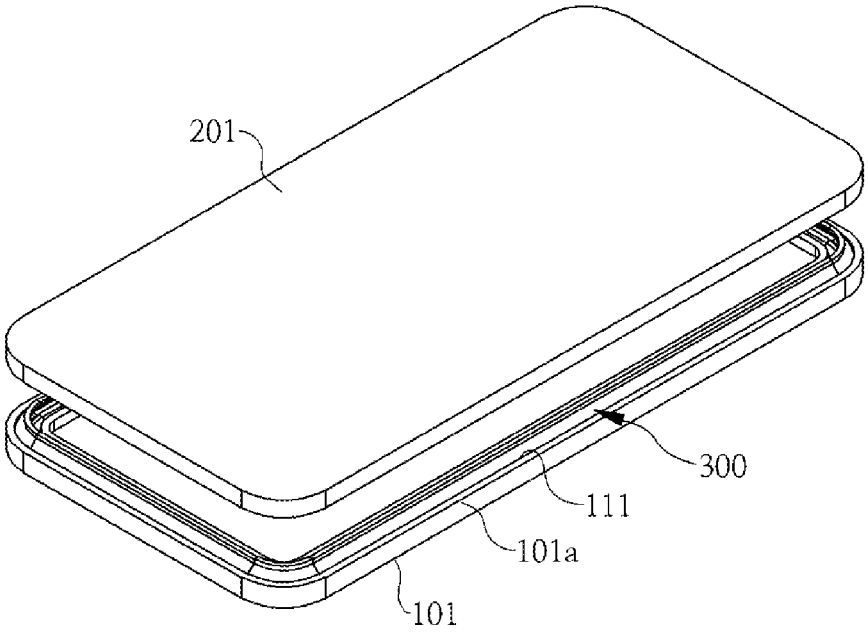
FIG. 23 is a perspective view showing a first body and a second body to which the packing structure according to the first embodiment of the present invention is applied.
Figure 24:
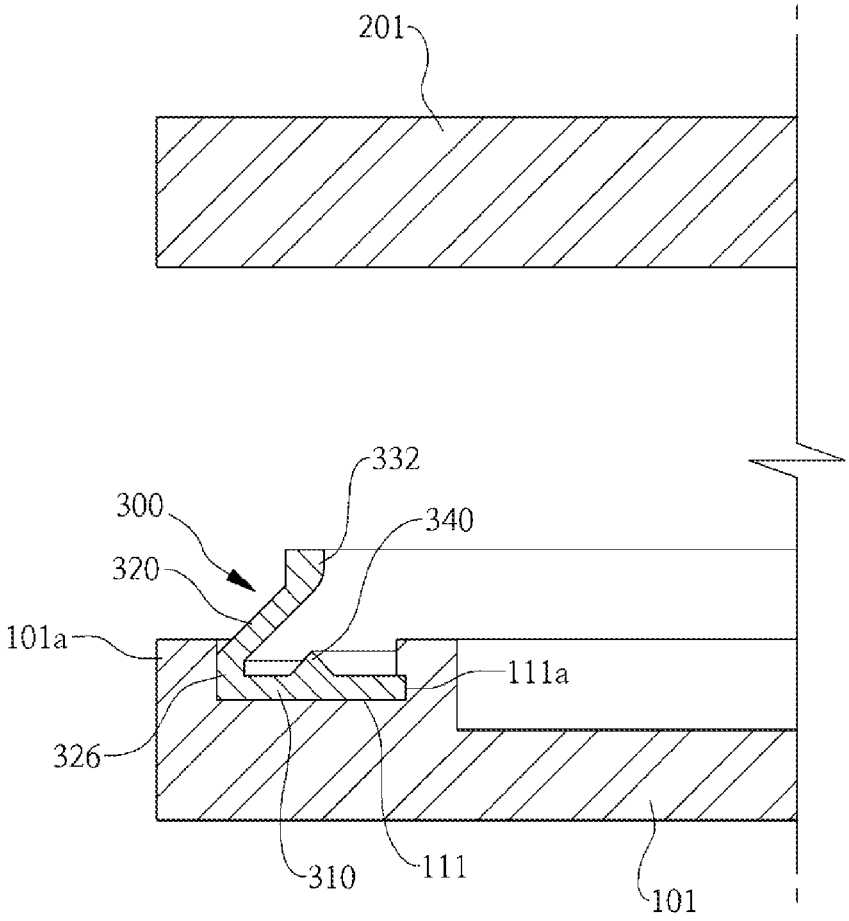
FIG. 24 is a sectional view showing the first body and the second body to which the packing structure according to the first embodiment of the present invention is applied.
Figure 25:
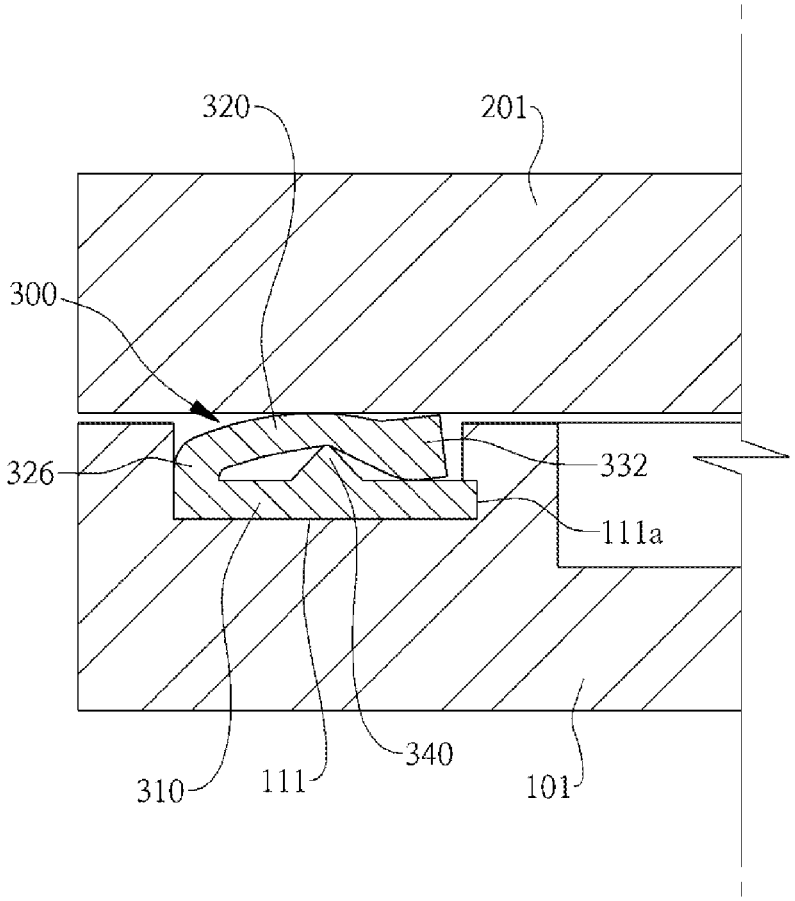
FIG. 25 is a sectional view showing a state where the first body and the second body, to which the packing structure according to the first embodiment of the present invention is applied, are coupled to each other.

FIG. 23 is a perspective view showing a first body and a second body to which the packing structure according to the first embodiment of the present invention is applied, FIG. 24 is a sectional view showing the first body and the second body to which the packing structure according to the first embodiment of the present invention is applied, and FIG. 25 is a sectional view showing a state where the first body and the second body, to which the packing structure according to the first embodiment of the present invention is applied, are coupled to each other.

Referring to FIGS. 23 to 25, for example, a first body 101 and a second body 201 serve as a cover like a case for smartphones, and various parts, articles, or the like may be located in the gap between the first body 101 and the second body 201. The inner edges of the first body 101 facing the second body 201 come into close contact with the inner edges of the second body 201 facing the first body 101, so that the first body 101 and the second body 201 are coupled to each other. In this case, the first packing 300 is provided between the inner edges of the first body 101 and the inner edges of the second body 201 to allow the gap between the first body 101 and the second body 201 to be tightly sealed. To do this, a first edge portion 101*a* protrudes from the inner edges of the first body 101, and a concave portion 111 is formed along the first edge portion 101*a*. The second body 201 has the shape of a flat plate, but according to the present invention, the second body 201 is not limited thereto. Also, in some cases, the first edge portion 101*a* and the concave portion 111 may be formed on the second body 201, not on the first body 101. The first tight contact portion 310 comes into close contact with the concave portion 111. In this case, a fitting concave portion 111*a* is formed on one side or both sides of the concave portion 111, and the longitudinal end portion of the first tight contact portion 310 is extended and fitted to the fitting concave portion 111*a*.

Like this, since the end portion of the first tight contact portion 310 is fitted to the fitting concave portion 111*a*, the first tight contact portion 310 can be firmly coupled to the concave portion 111, without any escape from the concave portion 111. If the inner edges of the second body 201 are coupled to the first edge portion 101*a* of the first body 101, further, the first protrusion portion 332 comes into close contact with the inside of the second body 201 in such a manner as to be elastically deformed toward the first body 101 to pressurize the first tight contact portion 310 toward the first body 101, so that the gap between the first tight contact portion 310 and the concave portion 111 can be tightly sealed. Further, since the support protrusion 340 pressurizes the first extension portion 320 toward the second body 201, the gap between the first protrusion portion 332 connected to the first extension portion 320 and the second body 201 can be tightly sealed.

The specific structure of the first packing 300 has been already explained above, and accordingly, the explanation of the first packing 300 will be avoided below. Instead of the first packing 300, in some cases, the second packing 400 (See FIG. 18) may be located between the first body 101 and the second body 201. Further, the first body 101 and the second body 201 have the flat rectangular sectional shapes, but in some cases, they may have various section shapes like circular, oval, and polygonal section shapes.

Figure 26:
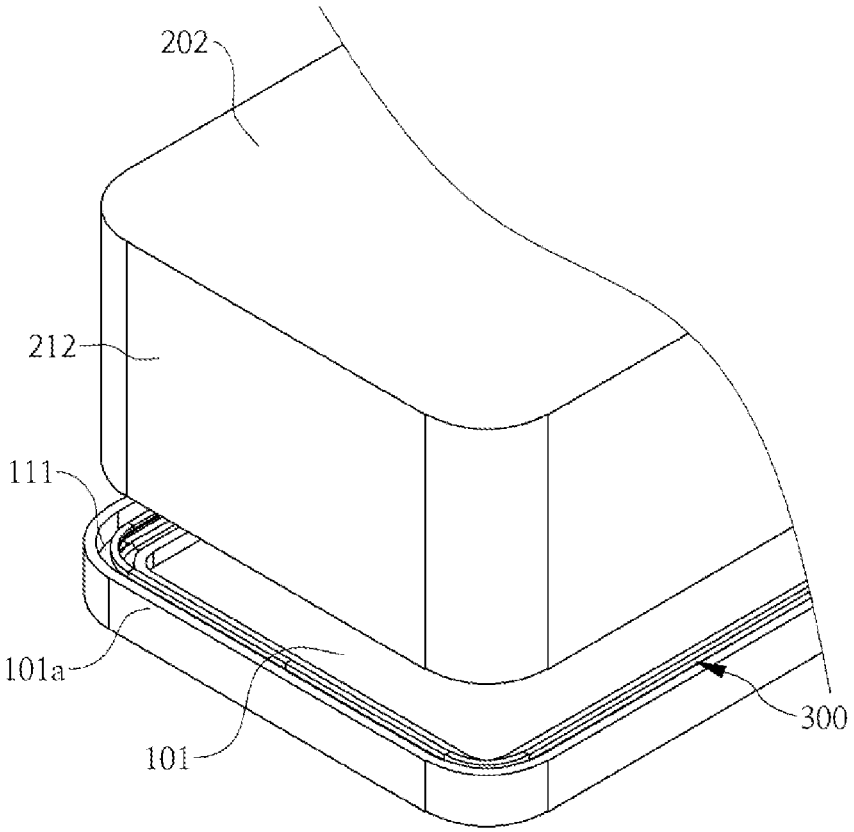
FIG. 26 is a perspective view showing other examples of the first body and the second body to which the packing structure according to the first embodiment of the present invention is applied.

FIG. 26 is a perspective view showing other examples of the first body and the second body to which the packing structure according to the first embodiment of the present invention is applied.

Referring to FIG. 26, a second body 202 has a second edge portion 212 protruding from the inner edges thereof toward the first edge portion 101*a* of the first body 101 in such a manner as to be longer than the first edge portion 101*a*. As a result, a relatively large gap is formed between the second body 202 and the second edge portion 212. Further, the first packing 300 is located in the concave portion 111 of the first body 101, and next, the first packing 300 is pressurized against the second edge portion 212 of the second body 202, so that a gap between the first body 101 and the second body 202 can be tightly sealed.

Figure 27:
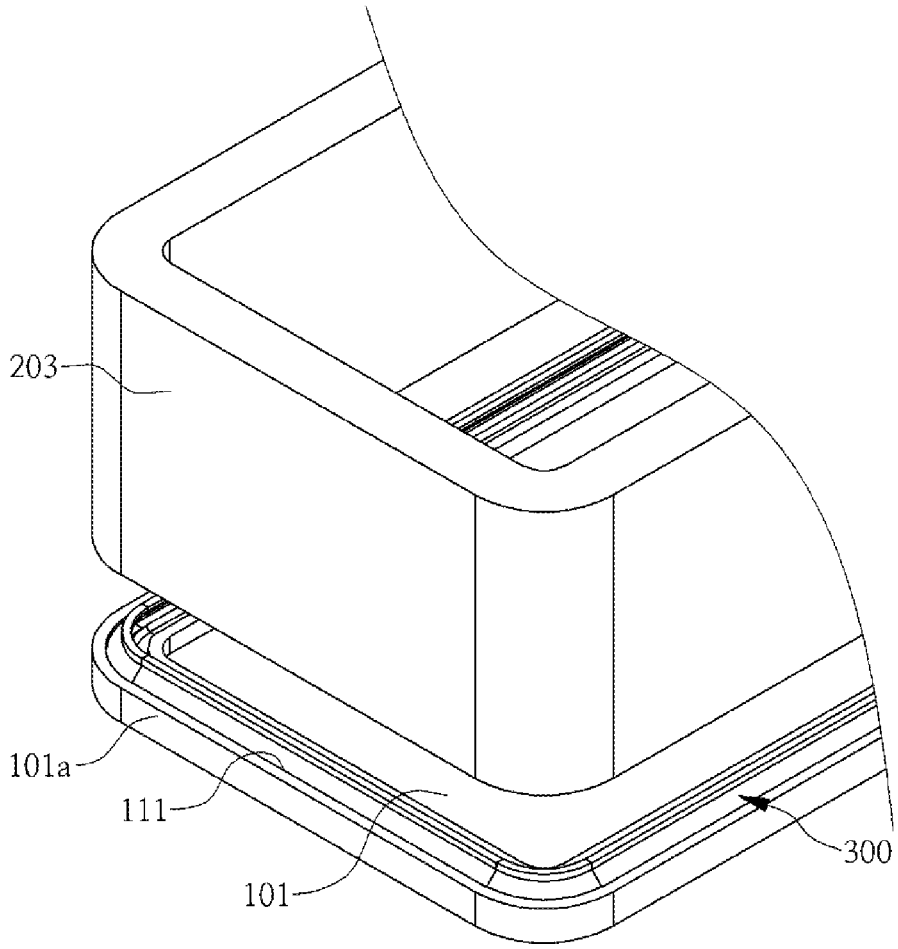
FIG. 27 is a perspective view showing yet other examples of the first body and the second body to which the packing structure according to the first embodiment of the present invention is applied.

FIG. 27 is a perspective view showing yet other examples of the first body and the second body to which the packing structure according to the first embodiment of the present invention is applied.

Referring to FIG. 27, a second body 203 is defined as the second edge portion 212 of FIG. 26, and the second body 203 protrudes from the first edge portion 101*a* in such a manner as to be spaced apart from the first edge portion 101*a* of the first body 101. Further, the first packing 300 is located in the concave portion 111 of the first body 101, and next, the first packing 300 is pressurized against the second body 203, so that a gap between the first body 101 and the second body 203 can be tightly sealed.

Figure 28:
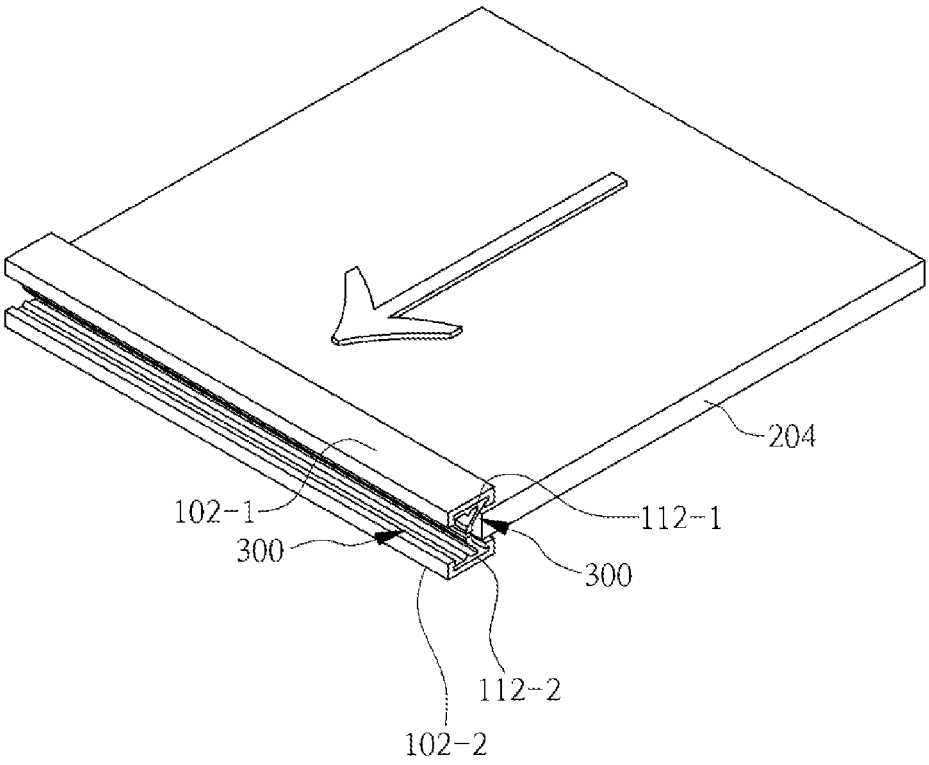
FIG. 28 is a perspective view showing still other examples of the first body and the second body to which the packing structure according to the first embodiment of the present invention is applied.
Figure 29:
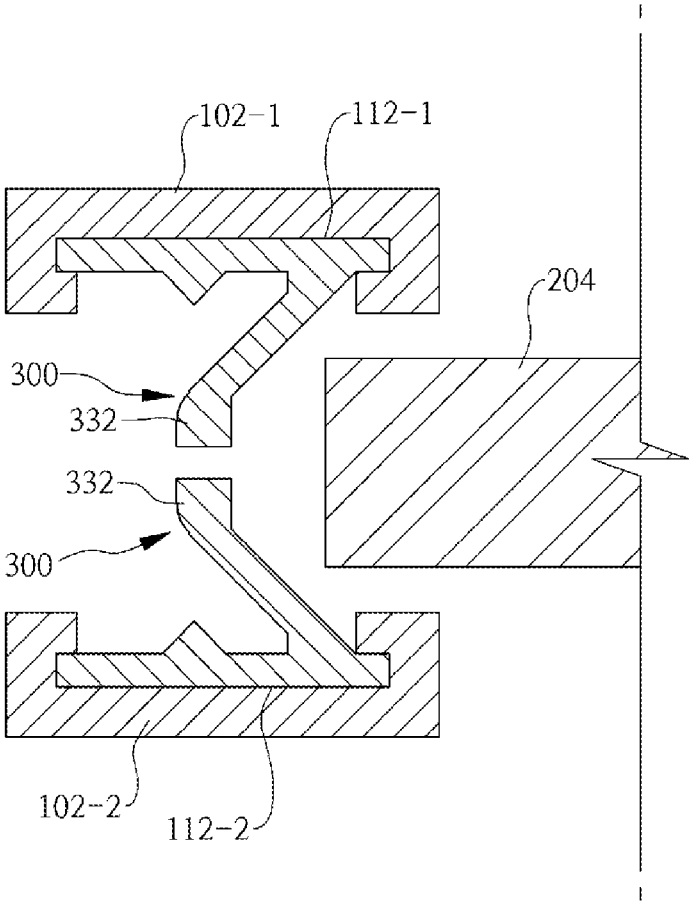
FIG. 29 is a sectional view showing other examples of the first body and the second body to which the packing structure according to the first embodiment of the present invention is applied.
Figure 30:
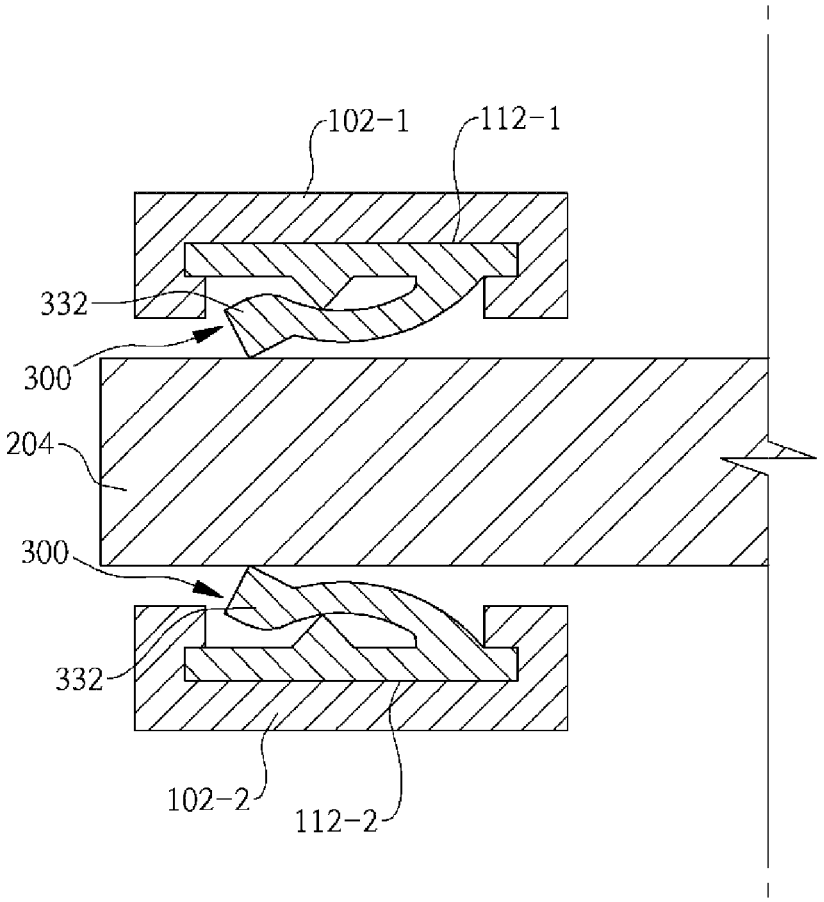
FIG. 30 is a sectional view showing a state where the first body and the second body, to which the packing structure according to the first embodiment of the present invention is applied, are coupled to each other.

FIG. 28 is a perspective view showing still other examples of the first body and the second body to which the packing structure according to the first embodiment of the present invention is applied, FIG. 29 is a sectional view showing other examples of the first body and the second body to which the packing structure according to the first embodiment of the present invention is applied, and FIG. 30 is a sectional view showing a state where the first body and the second body, to which the packing structure according to the first embodiment of the present invention is applied, are coupled to each other.

Referring to FIGS. 28 to 30, first bodies 102-1 and 102-2 have the shape of a pair of bars facing each other, and a second body 204 is inserted slidingly into the gap between one pair of first bodies 102-1 and 102-2. Further, one pair of first concave portions 112-1 and 112-2 are formed on the facing inner surfaces of one pair of first bodies 102-1 and 102-2, and one pair of first packings 300 are inserted into one pair of first concave portions 112-1 and 112-2. One pair of first packings 300 face each other in the symmetrical relation with each other in the state of being inserted into one pair of first concave portions 112-1 and 112-2 in such a manner as to allow first protrusion portions 332 of one pair of first packings 300 to face each other.

If the second body 204 is inserted slidingly into the gap between one pair of first bodies 102-1 and 102-2, further, the gap between one first body 101-1 and one side of the second body 204 is tightly sealed by means of one first packing 300, and the gap between the other first body 101-2 and the other side of the second body 204 is tightly sealed by means of the other first packing 300.

Figure 31:
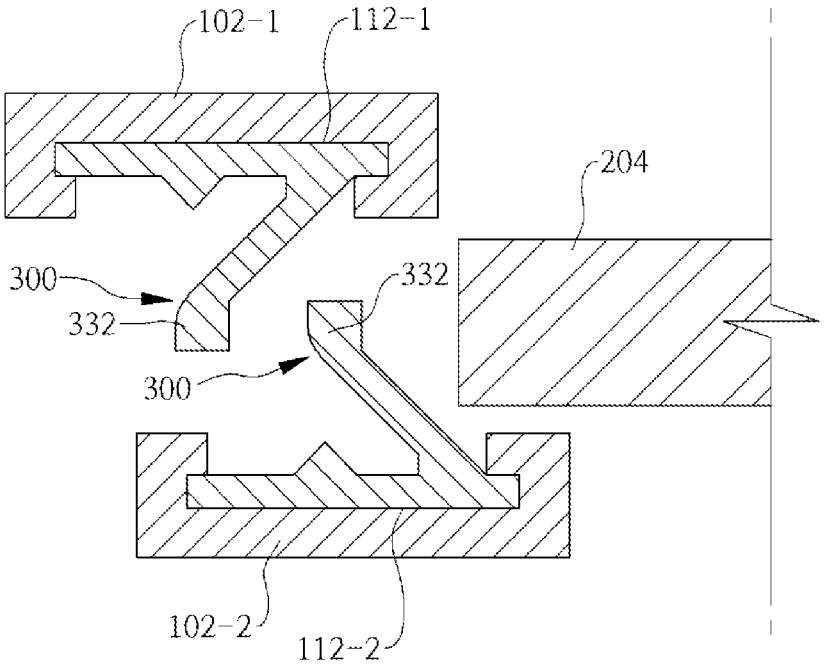
FIG. 31 is a sectional view showing still other examples of the first body and the second body to which the packing structure according to the first embodiment of the present invention is applied.

FIG. 31 is a sectional view showing still other examples of the first body and the second body to which the packing structure according to the first embodiment of the present invention is applied.

Referring to FIG. 31, one pair of first bodies 102-1 and 102-2 and the second body 204 are similar to those as shown in FIGS. 28 to 30, but one pair of first bodies 102-1 and 102-2 face each other in such a manner as to be somewhat misaligned with each other. Further, the first protrusion portions 332 of one pair of first packings 300 are misaligned with each other according to the arrangements of one pair of first bodies 102-1 and 102-2.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A packing structure for sealing a gap between a first body and a second body, comprising:

a first packing configured to be located between the first body and an inner surface of the second body, wherein the first packing comprises:

a tight contact portion whose inner periphery is configured to come into contact with the first body;

an auxiliary contact protrusion protruding from the inner periphery of the tight contact portion;

a first extension portion extending inclinedly upward from a lower outer periphery of the tight contact portion and configured to extend towards the inner surface of the second body;

a support protrusion protruding from an outer periphery of the tight contact portion towards the first extension portion; and a first protrusion portion protruding bendedly from the end portion of the first extension portion towards the inner surface of the second body to come into contact with the inner surface of the second body, wherein:

a pressurization point located on a top end periphery of the first extension portion is configured to be supported by the support protrusion when the first packing seals the gap, such that only the first protrusion portion comes into contact with the inner surface of the second body in order to keep the gap sealed and makes the second body slidable upward and downward with respect to the first body by minimizing the contact between the inner surface of the second body and the first packing;

the first protrusion portion has two edge peripheries which are angled, wherein one edge periphery comes into contact with the inner surface of the second body, and the other edge periphery does not come into contact with the inner surface of the second body;

the cross section of the support protrusion has a triangular shape to prevent deformation of the first protrusion portion resulting from the sliding of the second body; and the auxiliary contact protrusion is configured to pressurize the first body when the first extension portion is elastically deformed towards the tight contact portion by the pressure given by the second body, so that the pressurization point pressurizes the support protrusion, thus pressure is passed from the support protrusion to the auxiliary contact protrusion having a predetermined height.

2. The packing structure according to claim 1, wherein the first extension portion comprises a first top extension portion, a first underside extension portion located on an underside of the first top extension portion, and a vertical extension portion extended from a side periphery of the first top extension portion connected to the tight contact portion in such a manner as to be vertical with respect to the tight contact portion.

* * * * *